US012768141B2

(12) United States Patent
Suzuki et al.

(10) Patent No.: US 12,768,141 B2
(45) Date of Patent: Oct. 20, 2026

(54) WORK MACHINE

(71) Applicant: KOMATSU LTD., Tokyo (JP)

(72) Inventors: Junichiro Suzuki, Tokyo (JP); Shinobu Nagura, Tokyo (JP); Tomoaki Ozaki, Tokyo (JP)

(73) Assignee: KOMATSU LTD., Tokyo (JP)

( * ) Notice: Subject to any disclaimer, the term of this patent is extended or adjusted under 35 U.S.C. 154(b) by 0 days.

(21) Appl. No.: 19/131,244

(22) PCT Filed: Sep. 14, 2023

(86) PCT No.: PCT/JP2023/033516
§ 371 (c)(1),
(2) Date: May 20, 2025

(87) PCT Pub. No.: WO2024/116550
PCT Pub. Date: Jun. 6, 2024

(65) Prior Publication Data

US 2026/0185329 A1 Jul. 2, 2026

(30) Foreign Application Priority Data

Nov. 29, 2022 (JP) ..... 2022-189946

(51) Int. Cl.
*E02F 9/22* (2006.01)

(52) U.S. Cl.
CPC ..... *E02F 9/2253* (2013.01); *E02F 9/2203* (2013.01); *E02F 9/2228* (2013.01); *E02F 9/226* (2013.01); *E02F 9/2285* (2013.01); *E02F 9/2296* (2013.01)

(58) Field of Classification Search
None
See application file for complete search history.

(56) References Cited

U.S. PATENT DOCUMENTS 5,560,204 A 10/1996 Ishihama et al.
11,186,968 B2 * 11/2021 Ono ..... E02F 9/2066
12,435,493 B2 * 10/2025 Horii ..... E02F 9/2228

FOREIGN PATENT DOCUMENTS

JP H06-048197 A 2/1994
JP 2006-336730 A 12/2006

* cited by examiner

*Primary Examiner* — Michael Quandt
(74) *Attorney, Agent, or Firm* — Troutman Pepper Locke LLP

(57) ABSTRACT

A work machine includes: a first travel operation valve 13; a second travel operation valve 14; a work equipment operation valve 15; a first pressure compensation valve of the first travel operation valve 13; a second pressure compensation valve of the second travel operation valve 14; a bypass flow path; a travel communication valve 26; a temperature sensor 27; and a control device 6 configured to adjust a stroke of the travel communication valve 26 based on detection data from the temperature sensor 27 in a state in which each of the first travel operation valve 13 and the second travel operation valve 14 is disposed at a neutral position.

7 Claims, 14 Drawing Sheets

WORK MACHINE

TECHNICAL FIELD

The present disclosure relates to a work machine.

BACKGROUND ART

In technical fields related to work machines, a work machine is known including a load sensing control circuit, such as a work machine disclosed in Patent Document 1. In a load sensing system, a discharge amount of hydraulic oil from a hydraulic pump is adjusted based on a differential pressure between a discharge pressure of the hydraulic oil from the hydraulic pump and a load sensing pressure (LS pressure) corresponding to a load pressure of a hydraulic actuator. In addition, an LS drop property is known of the LS pressure decreasing as the load pressure increases.

CITATION LIST

Patent Literature

Patent Document 1: JP 2006-336730 A

SUMMARY OF INVENTION

Technical Problem

In the load sensing system, an LS drop amount indicating a decrease amount of the load pressure is set by an LS inlet throttle. When a temperature of the hydraulic oil changes, a viscosity of the hydraulic oil changes. As a result, the LS drop amount may fluctuate. When the LS drop amount fluctuates, an appropriate LS pressure may not be obtained. When the appropriate LS pressure is not obtained, operability of work equipment may deteriorate. For example, an operation amount of a work lever and an operation speed of the work equipment may not match each other, or hunting of the work equipment may occur.

An object of the present disclosure is to suppress deterioration in operability of work equipment.

Solution to Problem

According to the present disclosure, there is provided a work machine including: a hydraulic pump configured to change a discharge amount of hydraulic oil based on a differential pressure between a pump discharge pressure and a load sensing pressure corresponding to a load pressure input via a signal flow path; a first travel motor configured to be driven by the hydraulic oil supplied from the hydraulic pump; a second travel motor configured to be driven by the hydraulic oil supplied from the hydraulic pump; a work equipment cylinder configured to be driven by the hydraulic oil supplied from the hydraulic pump; a first travel operation valve configured to control a flow rate and a direction of the hydraulic oil supplied from the hydraulic pump to the first travel motor; a second travel operation valve configured to control a flow rate and a direction of the hydraulic oil supplied from the hydraulic pump to the second travel motor; a work equipment operation valve configured to control a flow rate and a direction of the hydraulic oil supplied from the hydraulic pump to the work equipment cylinder; a first pressure compensation valve connected to the signal flow path via a first inlet flow path, the first pressure compensation valve being configured to compensate for a differential pressure across the first travel operation valve based on the load sensing pressure; a second pressure compensation valve connected to the signal flow path via a second inlet flow path, the second pressure compensation valve being configured to compensate for a differential pressure across the second travel operation valve based on the load sensing pressure; a bypass flow path configured to bypass at least part of the second inlet flow path; a travel communication valve disposed at a coupling flow path coupling the first travel operation valve and the second travel operation valve; a temperature sensor configured to detect a hydraulic oil temperature indicating a temperature of the hydraulic oil; and a control device configured to adjust a stroke of the travel communication valve based on detection data from the temperature sensor in a state in which each of the first travel operation valve and the second travel operation valve is disposed at a neutral position.

Advantageous Effects of Invention

According to the present disclosure, deterioration in operability of work equipment is suppressed.

DESCRIPTION OF EMBODIMENTS

Hereinafter, embodiments of the disclosure will be described with reference to the drawings, but the disclosure is not limited to the embodiments. Components of the embodiments described below can be combined as appropriate. In addition, some components may not be used in some cases.

First Embodiment

Work Machine

Figure 1:
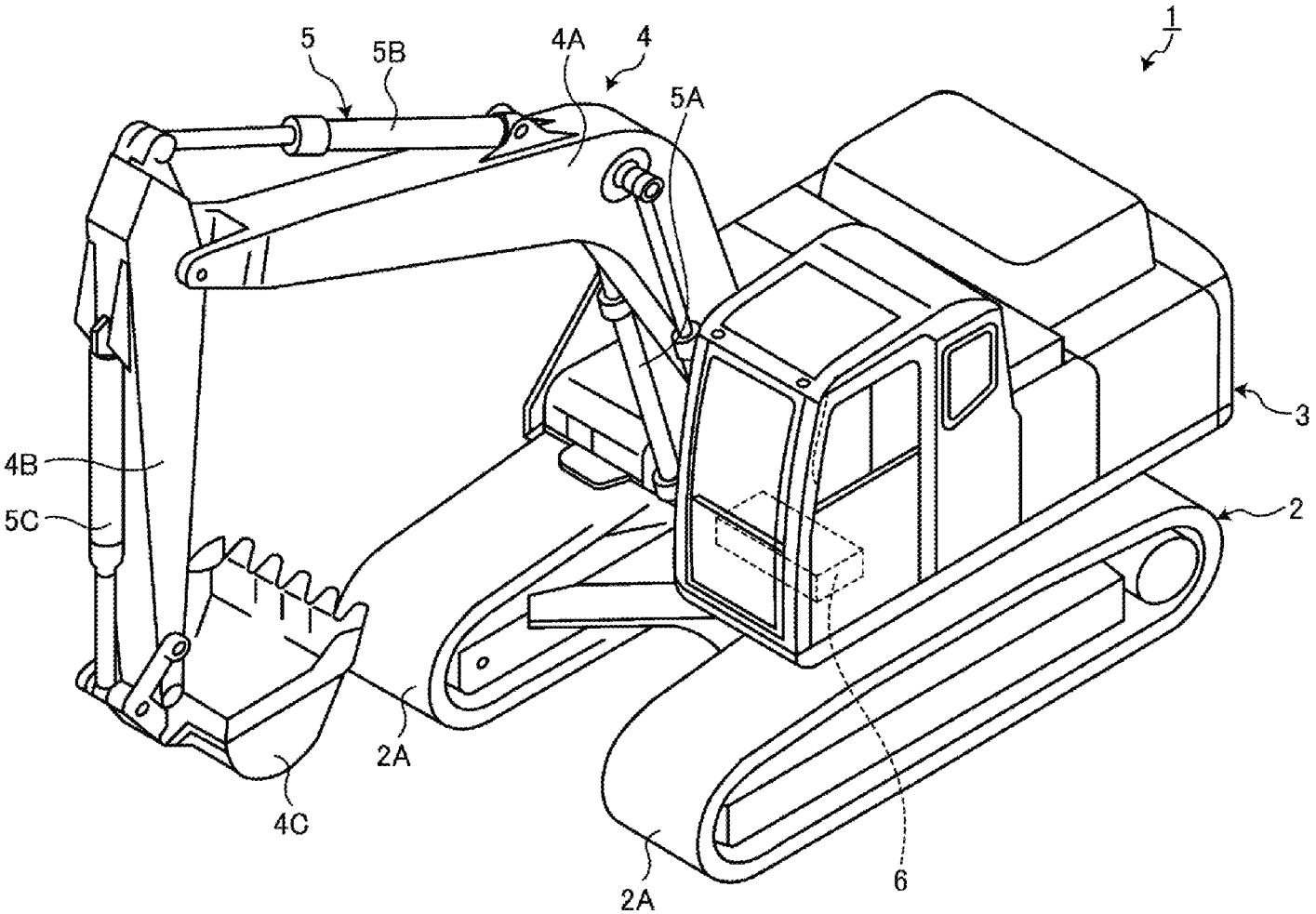
FIG. 1 is a perspective view illustrating a work machine according to a first embodiment.

A first embodiment will be described. FIG. 1 is a perspective view illustrating a work machine 1 according to the present embodiment. The work machine 1 operates at a work site. In the present embodiment, the work machine 1 is a hydraulic excavator. In the following description, the work machine 1 is appropriately referred to as a hydraulic excavator 1. The hydraulic excavator 1 includes a traveling body 2, a rotating body 3, work equipment 4, a work equipment cylinder 5, and a control device 6. The traveling body 2 travels while supporting the rotating body 3. The traveling body 2 includes a pair of crawler belts 2A. The crawler belts 2A are rotated by a travel motor. The crawler belts 2A are rotated and thus the traveling body 2 travels. The rotating body 3 is supported by the traveling body 2. The rotating body 3 is provided with a cab. The work equipment 4 is attached to the rotating body 3. The work equipment 4 includes a boom 4A, an arm 4B, and a bucket 4C. The work equipment cylinder 5 causes the work equipment 4 to operate. The work equipment cylinder 5 is a hydraulic cylinder. The work equipment cylinder 5 includes a boom cylinder 5A, an arm cylinder 5B, and a bucket cylinder 5C. The control device 6 includes a computer system. The control device 6 controls the hydraulic excavator 1.

Hydraulic System

Figure 2:
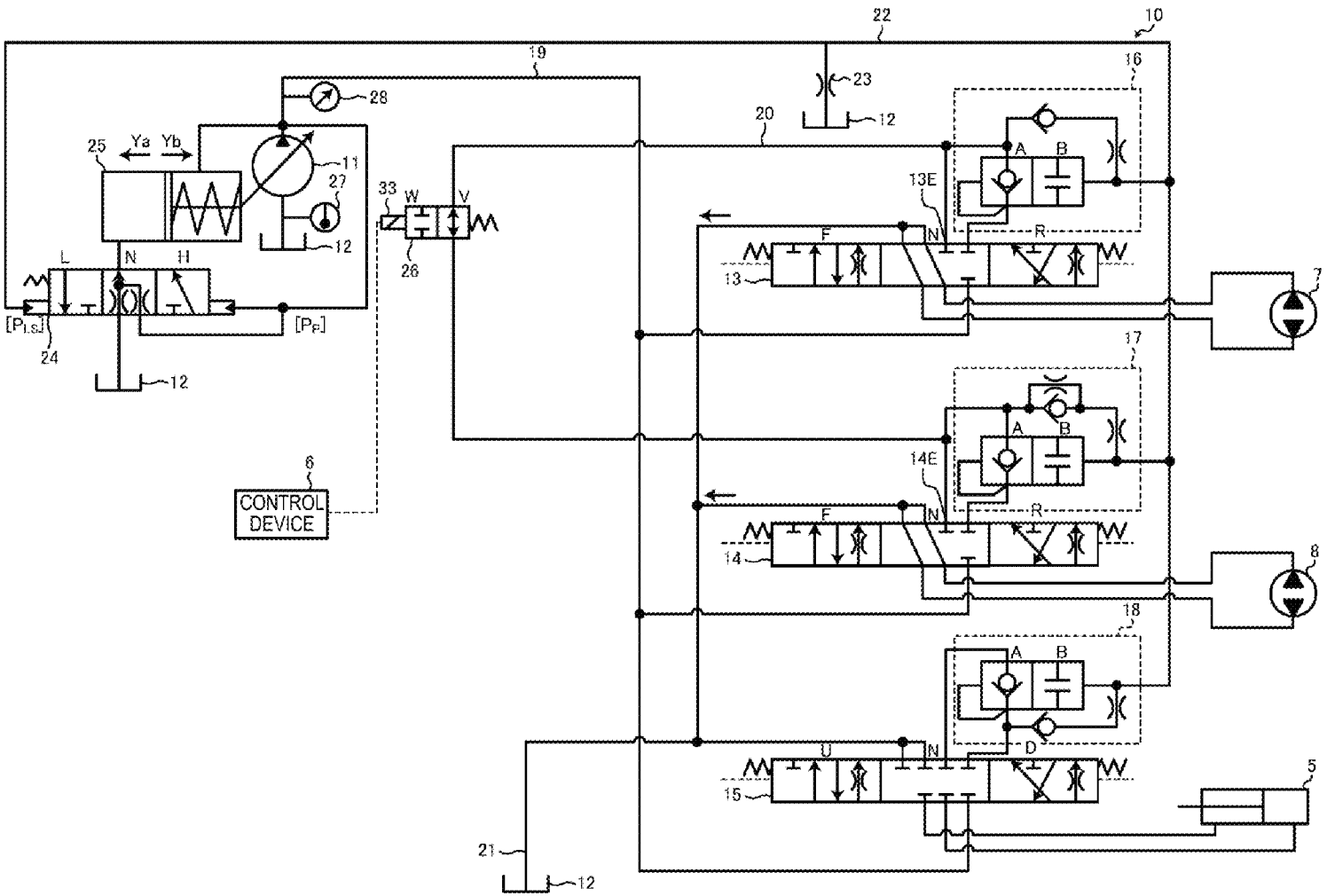
FIG. 2 is a diagram illustrating a hydraulic system of the work machine according to the first embodiment.
Figure 3:
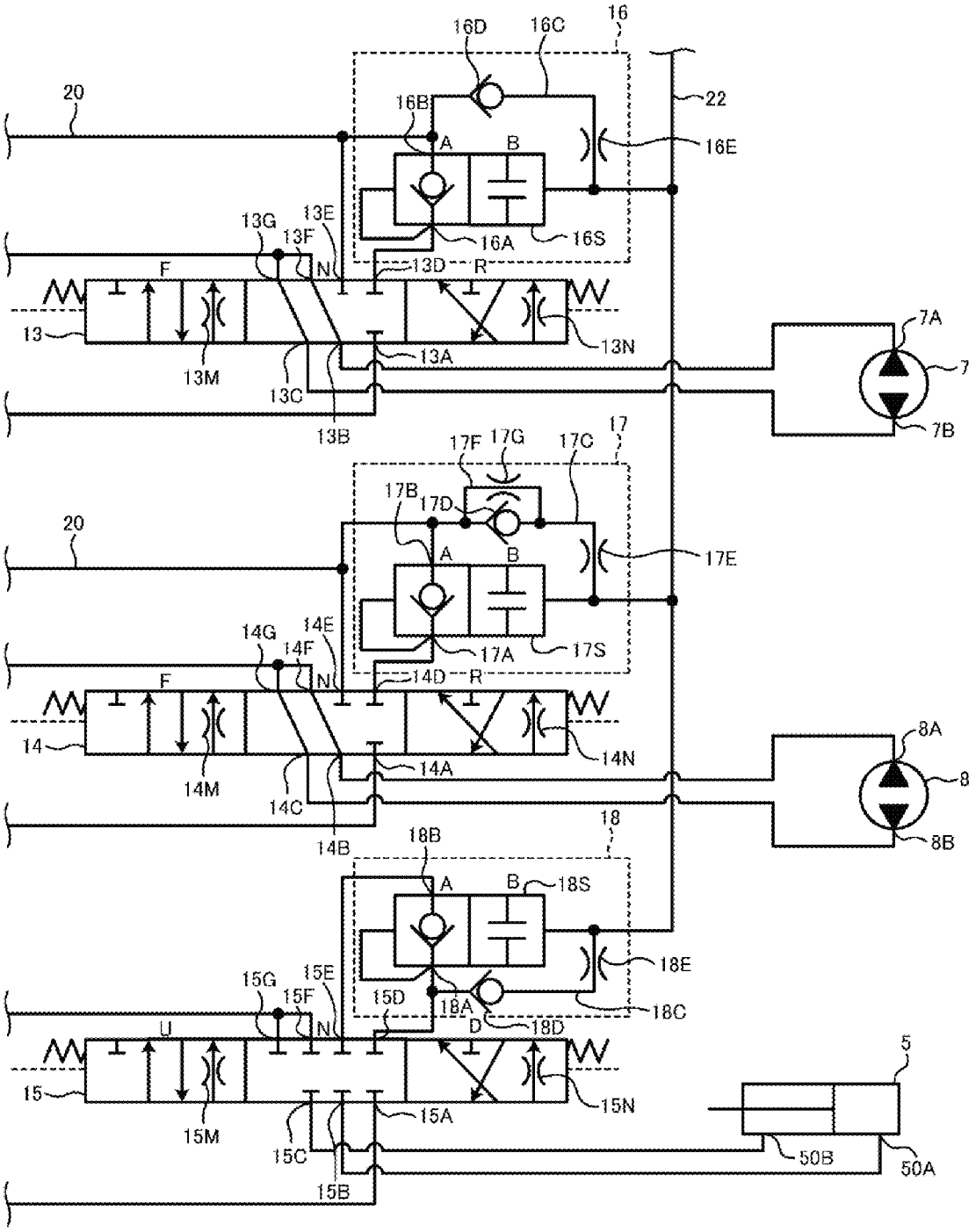
FIG. 3 is an enlarged view of part of the hydraulic system according to the first embodiment.
Figure 4:
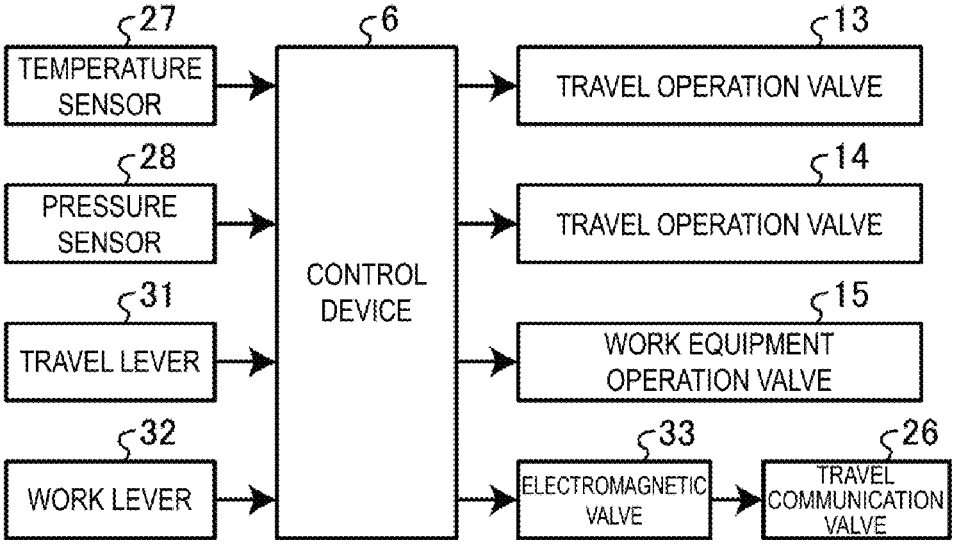
FIG. 4 is a block diagram schematically illustrating the hydraulic system according to the first embodiment.

FIG. 2 is a diagram illustrating a hydraulic system 10 of the hydraulic excavator 1 according to the present embodiment. FIG. 3 is an enlarged view of part of the hydraulic system 10 according to the present embodiment. FIG. 4 is a block diagram schematically illustrating the hydraulic system 10 according to the present embodiment. The hydraulic system 10 includes a load sensing control circuit.

The hydraulic system 10 includes a hydraulic pump 11, a hydraulic oil tank 12, a travel motor 7, a travel motor 8, the work equipment cylinder 5, a travel operation valve 13, a travel operation valve 14, a work equipment operation valve 15, a pressure compensation unit 16 including a pressure compensation valve 16S, a pressure compensation unit 17 including a pressure compensation valve 17S, a pressure compensation unit 18 including a pressure compensation valve 18S, a load sensing valve 24 (LS valve), a servo piston 25, a travel communication valve 26, a temperature sensor 27, and a pressure sensor 28.

The hydraulic pump 11 is a variable capacity hydraulic pump. A discharge port of the hydraulic pump 11 is connected to a pump flow path 19. The hydraulic pump 11 changes a discharge amount of hydraulic oil based on a differential pressure between a pump discharge pressure and a load sensing pressure (LS pressure) corresponding to a load pressure input via a signal flow path 22. The pump discharge pressure refers to a pressure of the hydraulic oil discharged from the discharge port of the hydraulic pump 11.

As illustrated in FIGS. 2 and 3, the travel motor 7 is a hydraulic motor driven by the hydraulic oil supplied from the hydraulic pump 11. The travel motor 7 rotates the left crawler belt 2A. The travel operation valve 13 controls a flow rate and a direction of the hydraulic oil supplied from the hydraulic pump 11 to the travel motor 7. The travel operation valve 13 includes a first port 13A, a second port 13B, a third port 13C, a fourth port 13D, a fifth port 13E, a sixth port 13F, and a seventh port 13G. The first port 13A is connected to the discharge port of the hydraulic pump 11 via the pump flow path 19. The second port 13B is connected to one port 7A of the travel motor 7. The third port 13C is connected to another port 7B of the travel motor 7. The fourth port 13D is connected to an input port 16A of the pressure compensation valve 16S. The fifth port 13E is connected to an output port 16B of the pressure compensation valve 16S. The fifth port 13E is connected to the travel communication valve 26 via a coupling flow path 20. Each of the sixth port 13F and the seventh port 13G is connected to the hydraulic oil tank 12 via a tank flow path 21.

As illustrated in FIG. 4, the hydraulic excavator 1 includes a travel lever 31. The travel lever 31 is disposed in the cab of the rotating body 3. The travel lever 31 is operated by an operator. Pilot ports are provided at both end portions of the travel operation valve 13. Based on an operation amount of the travel lever 31, pilot pressures are input to the pilot ports of the travel operation valve 13. As illustrated in FIGS. 2 and 3, in a state in which the pilot pressures are not input, the travel operation valve 13 is disposed at a neutral position N where the hydraulic oil is not supplied to the travel motor 7. The pilot pressure is input to the pilot port at one end portion of the travel operation valve 13, and thus the travel operation valve 13 is disposed at a forward position F for causing the traveling body 2 to travel forward. When the travel operation valve 13 is disposed at the forward position F, the hydraulic oil from the hydraulic pump 11 flows into the port 7A of the travel motor 7 via the first port 13A, a meter-in throttle 13M, the fourth port 13D, the pressure compensation valve 16S, the fifth port 13E, and the second port 13B. The hydraulic oil flowing out from the port 7B of the travel motor 7 is sent to the hydraulic oil tank 12 via the third port 13C, the sixth port 13F, and the tank flow path 21. The pilot pressure is input to the pilot port at the other end portion of the travel operation valve 13, and thus the travel operation valve 13 is disposed at a reverse position R for causing the traveling body 2 to travel in reverse. When the travel operation valve 13 is disposed at the reverse position R, the hydraulic oil from the hydraulic pump 11 flows into the port 7B of the travel motor 7 via the first port 13A, a meter-in throttle 13N, the fourth port 13D, the pressure compensation valve 16S, the fifth port 13E, and the third port 13C. The hydraulic oil flowing out from the port 7A of the travel motor 7 is sent to the hydraulic oil tank 12 via the second port 13B, the seventh port 13G, and the tank flow path 21.

As illustrated in FIGS. 2 and 3, the travel motor 8 is a hydraulic motor driven by the hydraulic oil supplied from the hydraulic pump 11. The travel motor 8 causes the right crawler belt 2A to rotate. The travel operation valve 14 controls a flow rate and a direction of the hydraulic oil supplied from the hydraulic pump 11 to the travel motor 8. The travel operation valve 14 includes a first port 14A, a second port 14B, a third port 14C, a fourth port 14D, a fifth port 14E, a sixth port 14F, and a seventh port 14G. The first port 14A is connected to the discharge port of the hydraulic pump 11 via the pump flow path 19. The second port 14B is connected to one port 8A of the travel motor 8. The third port 14C is connected to another port 8B of the travel motor 8. The fourth port 14D is connected to an input port 17A of the pressure compensation valve 17S. The fifth port 14E is connected to an output port 17B of the pressure compensation valve 17S. The fifth port 14E is connected to the travel communication valve 26 via the coupling flow path 20. Each of the sixth port 14F and the seventh port 14G is connected to the hydraulic oil tank 12 via the tank flow path 21.

Based on the operation amount of the travel lever 31, pilot pressures are input to pilot ports of the travel operation valve 14. As illustrated in FIGS. 2 and 3, in a state in which the pilot pressures are not input, the travel operation valve 14 is disposed at a neutral position N where the hydraulic oil is not supplied to the travel motor 8. The pilot pressure is input to the pilot port at one end portion of the travel operation valve 14, and thus the travel operation valve 14 is disposed at a forward position F for causing the traveling body 2 to travel forward. When the travel operation valve 14 is disposed at the forward position F, the hydraulic oil from the hydraulic pump 11 flows into the port 8A of the travel motor 8 via the first port 14A, a meter-in throttle 14M, the fourth port 14D, the pressure compensation valve 17S, the fifth port 14E, and the second port 14B. The hydraulic oil flowing out from the port 8B of the travel motor 8 is sent to the hydraulic oil tank 12 via the third port 14C, the sixth port 14F, and the tank flow path 21. The pilot pressure is input to the pilot port at the other end portion of the travel operation valve 14, and thus the travel operation valve 14 is disposed at a reverse position R for causing the traveling body 2 to travel in reverse. When the travel operation valve 14 is disposed at the reverse position R, the hydraulic oil from the hydraulic pump 11 flows into the port 8B of the travel motor 8 via the first port 14A, a meter-in throttle 14N, the fourth port 14D, the pressure compensation valve 17S, the fifth port 14E, and the third port 14C. The hydraulic oil flowing out from the port 8A of the travel motor 8 is sent to the hydraulic oil tank 12 via the second port 14B, the seventh port 14G, and the tank flow path 21.

As illustrated in FIGS. 2 and 3, the work equipment cylinder 5 is a hydraulic cylinder driven by the hydraulic oil supplied from the hydraulic pump 11. The work equipment operation valve 15 controls a flow rate and a direction of the hydraulic oil supplied from the hydraulic pump 11 to the work equipment cylinder 5. The work equipment operation valve 15 includes a first port 15A, a second port 15B, a third port 15C, a fourth port 15D, a fifth port 15E, a sixth port 15F, and a seventh port 15G. The first port 15A is connected to the discharge port of the hydraulic pump 11 via the pump flow path 19. The second port 15B is connected to one port 50A of the work equipment cylinder 5. The third port 15C is connected to another port 50B of the work equipment cylinder 5. The fourth port 13D is connected to an input port 18A of the pressure compensation valve 18S. The fifth port 15E is connected to an output port 18B of the pressure compensation valve 18S. Each of the sixth port 15F and the seventh port 15G is connected to the hydraulic oil tank 12 via the tank flow path 21.

As illustrated in FIG. 4, the hydraulic excavator 1 includes a work lever 32. The work lever 32 is disposed in the cab of the rotating body 3. The work lever 32 is operated by the operator. Pilot pressures are input to both end portions of the work equipment operation valve 15. Pilot ports are provided at both end portions of the work equipment operation valve 15. Based on an operation amount of the work lever 32, the pilot pressures are input to the pilot ports of the work equipment operation valve 15. As illustrated in FIGS. 2 and 3, in a state in which the pilot pressures are not input, the work equipment operation valve 15 is disposed at a neutral position N where the hydraulic oil is not supplied to the work equipment cylinder 5. The pilot pressure is input to the pilot port at one end portion of the work equipment operation valve 15, and thus the work equipment operation valve 15 is disposed at an extension position U for extending the work equipment cylinder 5. When the work equipment operation valve 15 is disposed at the extension position U, the hydraulic oil from the hydraulic pump 11 flows into the port 50A of the work equipment cylinder 5 via the first port 15A, a meter-in throttle 15M, the fourth port 15D, the pressure compensation valve 18S, the fifth port 15E, and the second port 15B. The hydraulic oil flowing out from the port 50B of the work equipment cylinder 5 is sent to the hydraulic oil tank 12 via the third port 15C, the sixth port 15F, and the tank flow path 21. The pilot pressure is input to the pilot port at the other end portion of the work equipment operation valve 15, and thus the work equipment operation valve 15 is disposed at a retraction position D for retracting the work equipment cylinder 5. When the work equipment operation valve 15 is disposed at the retraction position D, the hydraulic oil from the hydraulic pump 11 flows into the port 50B of the work equipment cylinder 5 via the first port 15A, a meter-in throttle 15N, the fourth port 15D, the pressure compensation valve 18S, the fifth port 15E, and the third port 15C. The hydraulic oil flowing out from the port 50A of the work equipment cylinder 5 is sent to the hydraulic oil tank 12 via the second port 15B, the seventh port 15G, and the tank flow path 21.

The pressure compensation unit 16 includes the pressure compensation valve 16S, an inlet flow path 16C that connects the output port 16B of the pressure compensation valve 16S and the signal flow path 22, a check valve 16D disposed at the inlet flow path 16C, and a load sensing inlet throttle 16E (LS inlet throttle) disposed at the inlet flow path 16C. The pressure compensation valve 16S is connected to the signal flow path 22 via the inlet flow path 16C. The pressure compensation valve 16S compensates for a differential pressure across the travel operation valve 13 based on an LS pressure input from the signal flow path 22. The pressure compensation valve 16S receives the LS pressure input from the signal flow path 22 to a pilot port of the pressure compensation valve 16S, and operates so as to keep the differential pressure across the travel operation valve 13 constant. The pressure compensation valve 16S moves between a fully open position A and a fully closed position B.

The pressure compensation unit 17 includes the pressure compensation valve 17S, an inlet flow path 17C that connects the output port 17B of the pressure compensation valve 17S and the signal flow path 22, a check valve 17D disposed at the inlet flow path 17C, and a load sensing inlet throttle 17E (LS inlet throttle) disposed at the inlet flow path 17C. The pressure compensation unit 17 also includes a bypass flow path 17F that bypasses at least part of the inlet flow path 17C, and a bypass throttle 17G disposed at the bypass flow path 17F. The pressure compensation valve 17S is connected to the signal flow path 22 via the inlet flow path 17C. The pressure compensation valve 17S compensates for a differential pressure across the travel operation valve 14 based on the LS pressure input from the signal flow path 22. The pressure compensation valve 17S receives the LS pressure input from the signal flow path 22 to a pilot port of the pressure compensation valve 17S, and operates so as to keep the differential pressure across the travel operation valve 14 constant. The pressure compensation valve 17S moves between a fully open position A and a fully closed position B.

The pressure compensation unit 18 includes the pressure compensation valve 18S, an inlet flow path 18C that connects the input port 18A of the pressure compensation valve 18S and the signal flow path 22, a check valve 18D disposed at the inlet flow path 18C, and a load sensing inlet throttle 18E (LS inlet throttle) disposed at the inlet flow path 18C. The pressure compensation valve 18S is connected to the signal flow path 22 via the inlet flow path 18C. The pressure compensation valve 18S compensates for a differential pressure across the work equipment operation valve 15 based on the LS pressure input from the signal flow path 22. The pressure compensation valve 18S receives the LS pressure input from the signal flow path 22 to a pilot port of the pressure compensation valve 18S, and operates so as to keep the differential pressure across the work equipment operation valve 15 constant. The pressure compensation valve 18S moves between a fully open position A and a fully closed position B.

A pressure corresponding to the highest load pressure among a load pressure of the travel motor 7, a load pressure of the travel motor 8, and a load pressure of the work equipment cylinder 5 is guided to the signal flow path 22 as an LS pressure $P_{LS}$. Part of the hydraulic oil guided to the signal flow path 22 is sent to the hydraulic oil tank 12 via a throttle 23. The LS pressure $P_{LS}$ guided to the signal flow path 22 is also guided to the LS valve 24.

As illustrated in FIG. 2, the LS valve 24 adjusts the discharge amount of the hydraulic oil discharged from the hydraulic pump 11 based on a differential pressure between a pump discharge pressure $P_P$ and the LS pressure $P_{LS}$ input from the signal flow path 22. The servo piston 25 is connected to the hydraulic pump 11. The LS valve 24 adjusts the discharge amount of the hydraulic oil from the hydraulic pump 11 via the servo piston 25. The LS valve 24 moves to a neutral position N, a low differential pressure position L, and a high differential pressure position H. When the differential pressure between the pump discharge pressure $P_P$ and the LS pressure $P_{LS}$ acting on the LS valve 24 is low, the LS valve 24 moves to the low differential pressure position L. When the LS valve 24 is disposed at the low differential pressure position L, the hydraulic oil of the servo piston 25 is sent to the hydraulic oil tank 12, and the servo piston 25 moves in an increase direction Ya for increasing a capacity of the hydraulic pump 11. The capacity of the hydraulic pump 11 increases, and thus the discharge amount of the hydraulic oil from the hydraulic pump 11 increases. When the differential pressure between the pump discharge pressure $P_P$ and the LS pressure $P_{LS}$ acting on the LS valve 24 is high, the LS valve 24 moves to the high differential pressure position H. When the LS valve 24 is disposed at the high differential pressure position H, part of the hydraulic oil discharged from the hydraulic pump 11 is introduced into the servo piston 25, and the servo piston 25 moves in a decrease direction Yb for decreasing the capacity of the hydraulic pump 11. The capacity of the hydraulic pump 11 decreases, and thus the discharge amount of the hydraulic oil from the hydraulic pump 11 decreases.

The travel communication valve 26 is disposed at the coupling flow path 20. The coupling flow path 20 couples the fifth port 13E of the travel operation valve 13 and the fifth port 14E of the travel operation valve 14. A spool of the travel communication valve 26 moves between an open position V at which the flow of the hydraulic oil between the travel operation valve 13 and the travel operation valve 14 is allowed and a closed position W at which the flow of the hydraulic oil between the travel operation valve 13 and the travel operation valve 14 is blocked. An electromagnetic valve 33 is connected to the travel communication valve 26. The control device 6 can move the spool of the travel communication valve 26 to the open position V and the closed position W by controlling the electromagnetic valve 33. The control device 6 controls the travel communication valve 26 based on an operation state of the travel lever 31. When the travel lever 31 is operated so that the hydraulic excavator 1 travels straight, the control device 6 moves the spool of the travel communication valve 26 to the open position V. For example, even when the travel lever 31 is operated so that the hydraulic excavator 1 travels straight, a rotation speed of the travel motor 7 and a rotation speed of the travel motor 8 may be different due to a manufacturing error or the like of at least one of the travel motor 7 or the travel motor 8. The spool of the travel communication valve 26 moves to the open position V when the hydraulic excavator 1 travels straight, and thus a difference between the load pressure of the travel motor 7 and the load pressure of the travel motor 8 decreases. Accordingly, the hydraulic excavator 1 can appropriately travel straight. When the travel lever 31 is operated so that the traveling body 2 is steered, the control device 6 moves the spool of the travel communication valve 26 to the closed position W. The steering of the traveling body 2 means that the traveling body 2 changes traveling direction (makes a curve).

The bypass flow path 17F is provided to suppress a decrease in a traveling speed of the traveling body 2 when the work equipment 4 is operated in a state in which the traveling body 2 is traveling. When activating the work equipment operation valve 15 so that the work equipment cylinder 5 operates, a phenomenon may occur in which the flow rate of the hydraulic oil supplied to the travel motor 7 and the travel motor 8 decreases, and the traveling speed of the traveling body 2 decreases. When the work equipment 4 is operated in a state in which the traveling body 2 is traveling, the load pressure of the work equipment cylinder 5 may be higher than the load pressures of the travel motor 7 and the travel motor 8. When the load pressure of the work equipment cylinder 5 is higher than the load pressures of the travel motor 7 and the travel motor 8, the high LS pressure $P_{LS}$ corresponding to the load pressure of the work equipment cylinder 5, which is the highest pressure, is input to each of the pressure compensation valve 16S and the pressure compensation valve 17S, and also input to the LS valve 24. When the LS pressure $P_{LS}$ is input from the signal flow path 22 to the pressure compensation unit 17, at least part of the hydraulic oil flowing from the signal flow path 22 into the pressure compensation unit 17 can flow through the bypass flow path 17F. Thus, the pressure of the signal flow path 22 decreases, and the pressure acting on the pilot port of the pressure compensation valve 17S from the signal flow path 22 decreases. Therefore, a decrease in the flow rate of the hydraulic oil supplied to the travel motor 8 is suppressed. Thus, a decrease in the traveling speed of the traveling body 2 is suppressed.

The temperature sensor 27 detects a hydraulic oil temperature indicating a temperature of the hydraulic oil. In the present embodiment, the temperature sensor 27 detects the temperature of the hydraulic oil flowing from the hydraulic oil tank 12 into the hydraulic pump 11.

The pressure sensor 28 detects the pressure of the hydraulic oil. In the present embodiment, the pressure sensor 28 detects the pump discharge pressure $P_P$ indicating the pressure of the hydraulic oil discharged from the discharge port of the hydraulic pump 11.

Adjustment of LS Pressure

Figure 5:
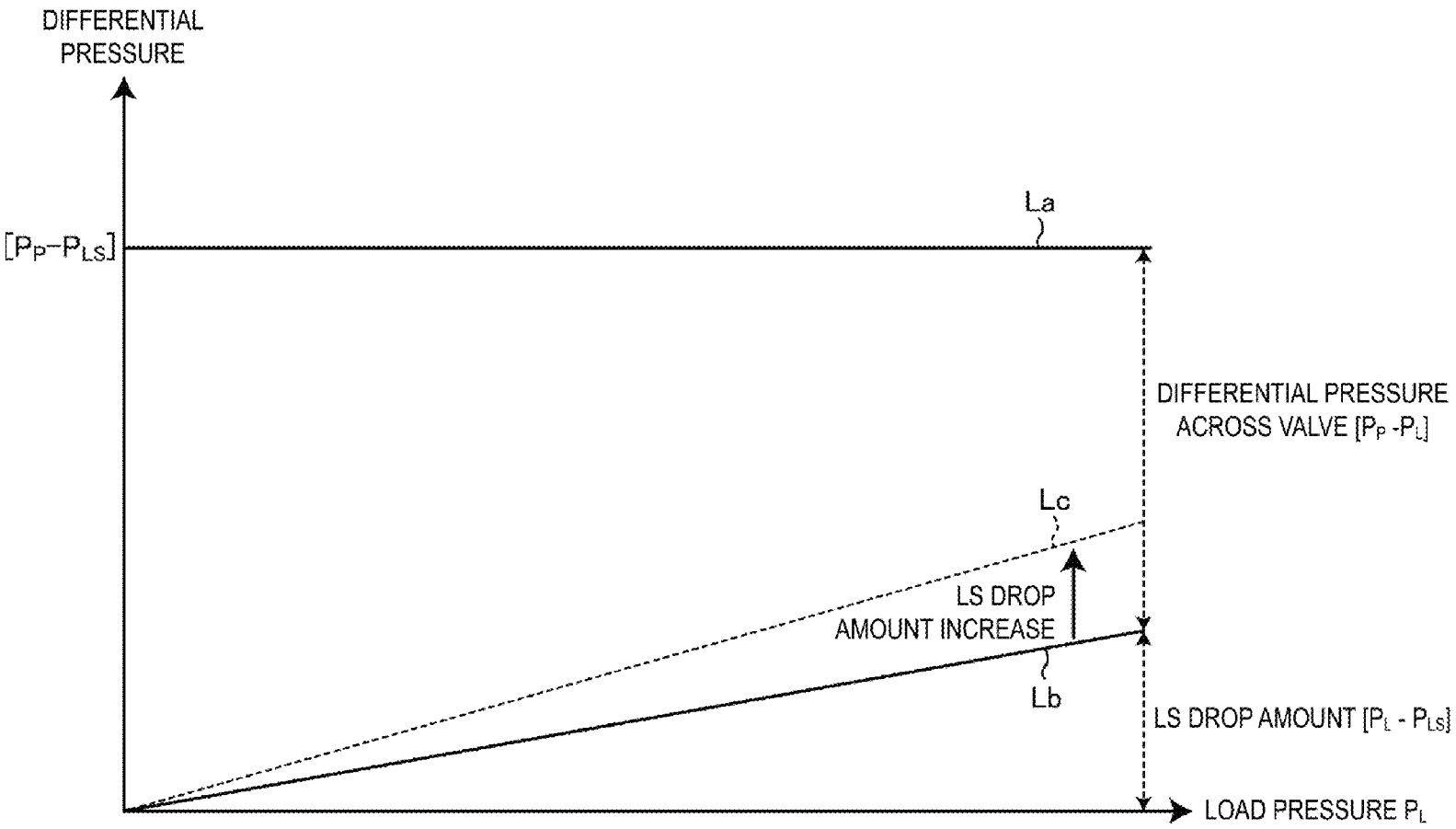
FIG. 5 is a diagram showing a relationship between a load pressure and a differential pressure according to the first embodiment.

FIG. 5 is a diagram showing a relationship between a load pressure $P_L$ and a differential pressure according to the present embodiment. In a load sensing system, the discharge amount of the hydraulic oil discharged from the hydraulic pump 11 is adjusted based on the differential pressure between the pump discharge pressure $P_P$ and the LS pressure $P_{LS}$ corresponding to the load pressure $P_L$ of a hydraulic actuator. In general, in the load sensing system, the discharge amount of the hydraulic oil discharged from the hydraulic pump 11 is adjusted by activating the LS valve 24 so that the pump discharge pressure $P_P$ becomes higher than the LS pressure $P_{LS}$ by a predetermined differential pressure. That is, as indicated by a line La in FIG. 5, the discharge amount of the hydraulic oil discharged from the hydraulic pump 11 is adjusted so that a value $[P_P-P_{LS}]$ becomes constant.

In the present embodiment, the LS pressure $P_{LS}$ corresponding to the load pressure $P_L$ is output by the LS inlet throttle 16E, the LS inlet throttle 17E, and the LS inlet throttle 18E. In the following description, the differential pressure $[P_L-P_{LS}]$ between the load pressure $P_L$ and the LS pressure $P_{LS}$ is appropriately referred to as an LS drop amount. As indicated by a line Lb in FIG. 5, a LS drop amount $[P_L-P_{LS}]$ increases as the load pressure $P_L$ increases. When the LS drop amount $[P_L-P_{LS}]$ increases, the LS drop amount $[P_L-P_{LS}]$ increases and a differential pressure $[P_P-P_L]$ across the work equipment operation valve 15 decreases in the constant value $[P_P-P_{LS}]$ indicated by the line La, so that the flow rate of the hydraulic oil passing through the work equipment operation valve 15 decreases. When the flow rate of the hydraulic oil passing through the work equipment operation valve 15 decreases, an operation speed of the work equipment 4 decreases. In the hydraulic system 10, an adjustment is made by the LS inlet throttles (16E, 17E, 18E) such that the appropriate LS drop amount $[P_L-P_{LS}]$ is obtained. Due to the appropriate LS drop amount $[P_L-P_{LS}]$, a property is obtained of the operation speed of the work equipment 4 slightly decreasing as the load pressure $P_L$ increases, achieving favorable operability of the work equipment 4.

As illustrated in FIG. 3, in the present embodiment, each of the LS inlet throttle 16E, the LS inlet throttle 17E, and the LS inlet throttle 18E is a fixed throttle. An opening area of each of the LS inlet throttle 16E, the LS inlet throttle 17E, and the LS inlet throttle 18E does not change. Each of the LS inlet throttle 16E, the LS inlet throttle 17E, and the LS inlet throttle 18E is optimized (selected) so that the desired LS drop amount $[P_L-P_{LS}]$ is obtained.

When the hydraulic oil temperature changes, a viscosity of the hydraulic oil changes. Therefore, when the hydraulic oil temperature changes, the LS drop amount $[P_L-P_{LS}]$ may fluctuate, and the appropriate LS pressure $P_{LS}$ may not be obtained. For example, when the hydraulic oil temperature becomes high, the viscosity of the hydraulic oil may decrease, the hydraulic oil may leak from a gap between a valve body and a spool of each of the travel operation valve 13 and the travel operation valve 14, the flow rate of the hydraulic oil passing through the LS inlet throttle may increase, and the LS drop amount $[P_L-P_{LS}]$ may increase. As indicated by a line Lc in FIG. 5, even at the same load pressure $P_L$, when the LS drop amount $[P_L-P_{LS}]$ increases, the differential pressure $[P_P-P_L]$ across the valve decreases. When the differential pressure $[P_P-P_L]$ across the work equipment operation valve 15 decreases, the operation speed of the work equipment 4 may decrease. When the hydraulic oil temperature becomes low, the LS drop amount $[P_L-P_{LS}]$ decreases and the differential pressure $[P_P-P_L]$ across the valve increases even at the same load pressure $P_L$. When the differential pressure $[P_P-P_L]$ across the work equipment operation valve 15 increases, the operation speed of the work equipment 4 may increase or hunting of the work equipment 4 may occur. That is, when the LS drop amount $[P_L-P_{LS}]$ fluctuates in accordance with the hydraulic oil temperature, the operability of the work equipment 4 may deteriorate. For example, the operation amount of the work lever 32 and the operation speed of the work equipment 4 may not match each other, or hunting of the work equipment 4 may occur.

In the present embodiment, when the work equipment 4 is operated in a state in which the traveling body 2 is stopped, the control device 6 adjusts a stroke of the travel communication valve 26 based on the hydraulic oil temperature so that the LS drop amount $[P_L-P_{LS}]$ for the load pressure $P_L$ of the work equipment cylinder 5 does not fluctuate greatly. That is, when activating the work equipment operation valve 15 in a state in which each of the travel operation valve 13 and the travel operation valve 14 is disposed at the neutral position N, the control device 6 adjusts the stroke of the travel communication valve 26 based on detection data from the temperature sensor 27. An opening area of the travel communication valve 26 is adjusted by adjusting the stroke of the travel communication valve 26. Based on the hydraulic oil temperature, the stroke of the travel communication valve 26 is changed, and the opening area of the travel communication valve 26 is changed. Thus, a fluctuation in the LS drop amount $[P_L-P_{LS}]$ is suppressed. Therefore, even when the hydraulic oil temperature changes, the desired LS pressure $P_{LS}$ can be obtained.

Figure 6:
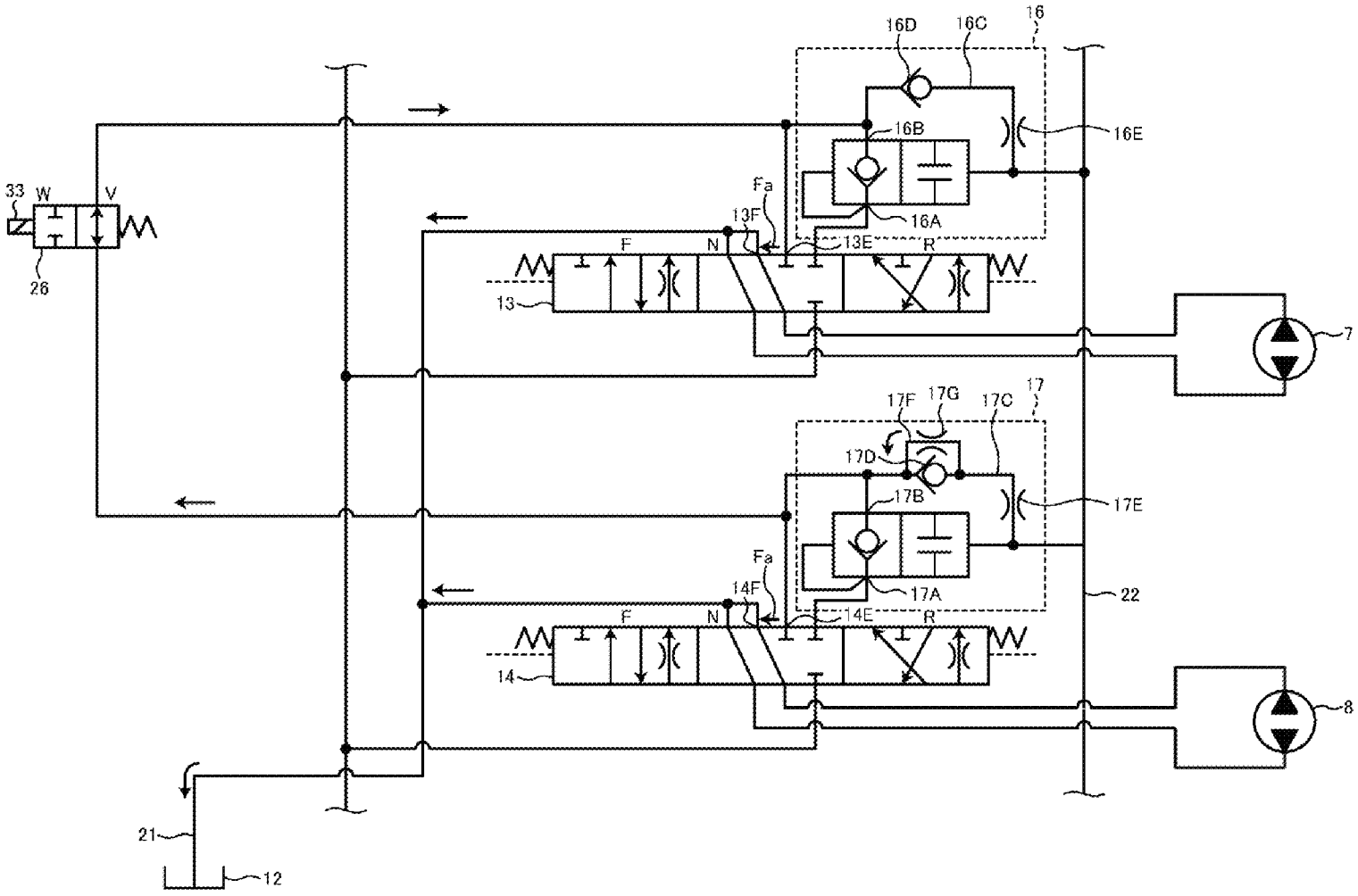
FIG. 6 is a diagram illustrating an operation of a travel communication valve according to the first embodiment.
Figure 7:
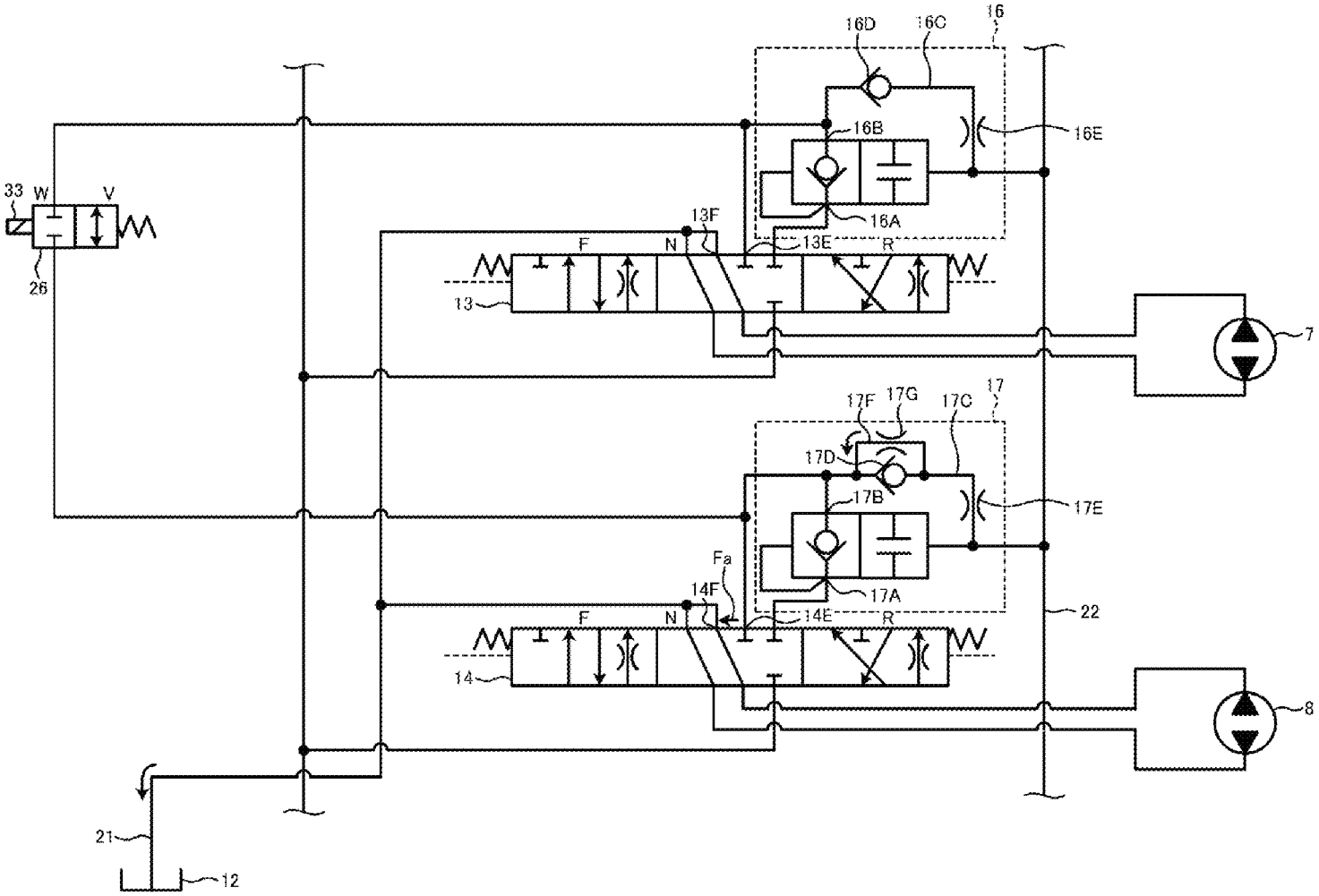
FIG. 7 is a diagram illustrating an operation of the travel communication valve according to the first embodiment.

FIGS. 6 and 7 are diagrams each illustrating an operation of the travel communication valve 26 according to the present embodiment. FIG. 6 illustrates a state of the travel communication valve 26 when the hydraulic oil temperature is low. FIG. 7 illustrates a state of the travel communication valve 26 when the hydraulic oil temperature is high.

As illustrated in FIG. 6, when the hydraulic oil temperature is low, the control device 6 moves the spool of the travel communication valve 26 to the open position V based on the detection data from the temperature sensor 27 illustrated in FIG. 2. That is, as the hydraulic oil temperature decreases, the control device 6 increases the opening area of the travel communication valve 26. Each of the travel operation valve 13 and the travel operation valve 14 is disposed at the neutral position N. The work equipment 4 operates, and thus the load pressure of the work equipment cylinder 5 is input to the signal flow path 22. The hydraulic oil in the signal flow path 22 flows into the bypass flow path 17F via the inlet flow path 17C. The hydraulic oil flowing into the bypass flow path 17F flows into the fifth port 14E.

Although the travel operation valve 14 is disposed at the neutral position N, the hydraulic oil flowing into the fifth port 14E is supplied to the sixth port 14F. The travel operation valve 14 is a spool valve. Generally, a slight gap is provided between a valve body and a spool for smooth sliding of the spool. Due to this gap, even when the travel operation valve 14 is disposed at the neutral position N, the hydraulic oil slightly leaks. Therefore, the hydraulic oil is supplied from the fifth port 14E to the sixth port 14F. Since the spool of the travel communication valve 26 is disposed at the open position V, at least part of the hydraulic oil supplied from the inlet flow path 17C to the bypass flow path 17F is sent to the travel operation valve 13 via the travel communication valve 26. The hydraulic oil sent to the travel operation valve 13 flows into the fifth port 13E. The hydraulic oil flowing into the fifth port 13E is supplied to (leaks to) the sixth port 13F.

At least part of the hydraulic oil supplied from the fifth port 14E to the sixth port 14F is sent to the hydraulic oil tank 12 via the tank flow path 21. The hydraulic oil leaking from the fifth port 13E to the sixth port 13F is also sent to the hydraulic oil tank 12 via the tank flow path 21. That is, when the spool of the travel communication valve 26 is disposed at the open position V, the hydraulic oil flows out from each of the travel operation valve 13 and the travel operation valve 14. The outflow of the hydraulic oil causes an LS drop property.

As illustrated in FIG. 7, when the hydraulic oil temperature is high, the control device 6 moves the spool of the travel communication valve 26 to the closed position W based on the detection data from the temperature sensor 27 illustrated in FIG. 2. That is, as the hydraulic oil temperature increases, the control device 6 decreases the opening area of the travel communication valve 26. Each of the travel operation valve 13 and the travel operation valve 14 is disposed at the neutral position N. The work equipment 4 operates, and thus the load pressure of the work equipment cylinder 5 is input to the signal flow path 22. The hydraulic oil in the signal flow path 22 flows into the bypass flow path 17F via the inlet flow path 17C. The hydraulic oil flowing into the bypass flow path 17F flows into the fifth port 14E.

The hydraulic oil flowing into the fifth port 14E leaks to the sixth port 14F. At least part of the hydraulic oil supplied from the fifth port 14E to the sixth port 14F is sent to the hydraulic oil tank 12 via the tank flow path 21. Since the spool of the travel communication valve 26 is disposed at the closed position W, the hydraulic oil supplied from the fifth port 14E to the sixth port 14F is not supplied to the travel operation valve 13. That is, when the spool of the travel communication valve 26 is disposed at the closed position W, the hydraulic oil flows out from the travel operation valve 14, but the hydraulic oil does not flow out from the travel operation valve 13. Although the outflow of the hydraulic oil causes the LS drop property, this LS drop amount is smaller than the LS drop amount $[P_L-P_{LS}]$ when the spool of the travel communication valve 26 is disposed at the open position V.

That is, when the hydraulic oil temperature is low, the hydraulic oil flows out from each of the travel operation valve 13 and the travel operation valve 14 to the hydraulic oil tank 12. When the hydraulic oil temperature is high, the hydraulic oil flows out from the travel operation valve 14 to the hydraulic oil tank 12, and the hydraulic oil does not flow out from the travel operation valve 13 to the hydraulic oil tank 12. Thus, when the hydraulic oil temperature is high, an increase in the LS drop amount $[P_L-P_{LS}]$ is suppressed. The control device 6 can suppress a fluctuation in the LS drop amount $[P_L-P_{LS}]$ by increasing the opening area of the travel communication valve 26 as the hydraulic oil temperature becomes lower and decreasing the opening area of the travel communication valve 26 as the hydraulic oil temperature becomes higher. Since a fluctuation in the LS drop amount $[P_L-P_{LS}]$ is suppressed, the desired LS pressure $P_{LS}$ can be obtained even when the hydraulic oil temperature changes.

Travel Communication Valve

Figure 8:
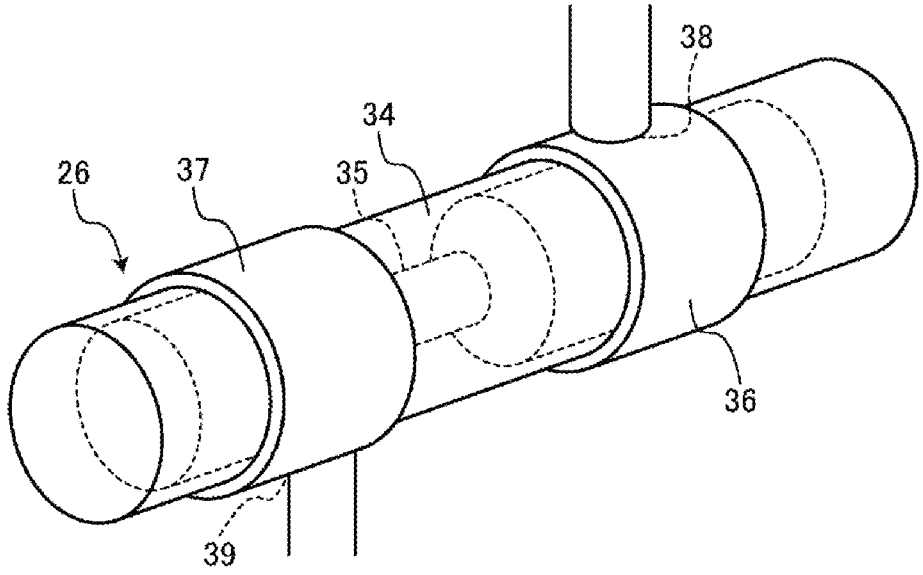
FIG. 8 is a diagram schematically illustrating the travel communication valve according to the first embodiment.

FIG. 8 is a diagram schematically illustrating the travel communication valve 26 according to the present embodiment. As illustrated in FIG. 8, the travel communication valve 26 includes a valve body 34 and a spool 35 movable inside the valve body 34. The valve body 34 includes an annular recess 36 and an annular recess 37. Each of the annular recess 36 and the annular recess 37 is disposed so as to surround the spool 35. An inflow port 38 for the hydraulic oil is provided at an inner peripheral portion of the annular recess 36, and an outflow port 39 for the hydraulic oil is provided at an inner peripheral portion of the annular recess 37.

Figure 9:
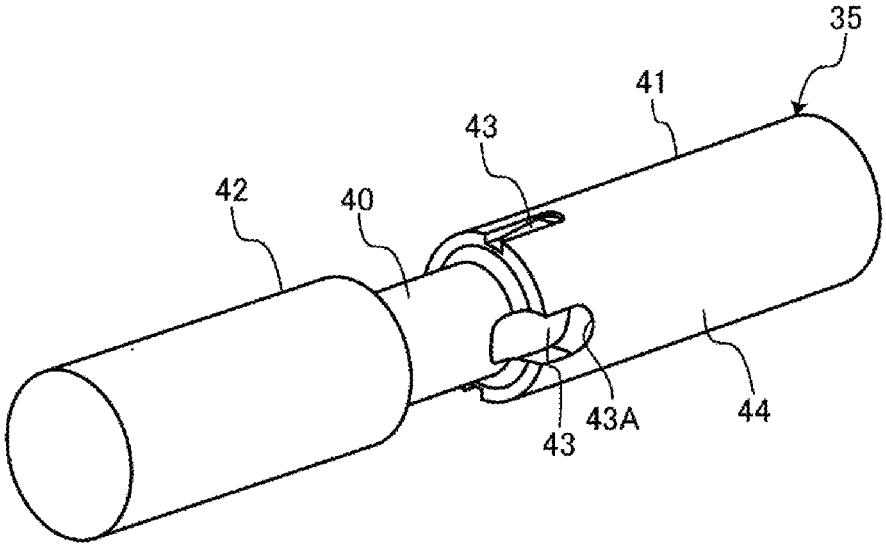
FIG. 9 is a diagram schematically illustrating a spool of the travel communication valve according to the first embodiment.

FIG. 9 is a diagram schematically illustrating the spool 35 of the travel communication valve 26 according to the present embodiment. The spool 35 includes a small-diameter rod portion 40, a large-diameter rod portion 41 connected to a right end portion of the small-diameter rod portion 40, and a large-diameter rod portion 42 connected to a left end portion of the small-diameter rod portion 40. An outer diameter of the small-diameter rod portion 40 is smaller than an outer diameter of the large-diameter rod portion 41 and an outer diameter of the large-diameter rod portion 42. A cutout portion 43 is formed at a left end portion of an outer peripheral surface of the large-diameter rod portion 41. In the following description, a region of the outer peripheral surface of the large-diameter rod portion 41 to the right of a right end portion 43A of the cutout portion 43 is appropriately referred to as a land surface 44.

Figure 10:
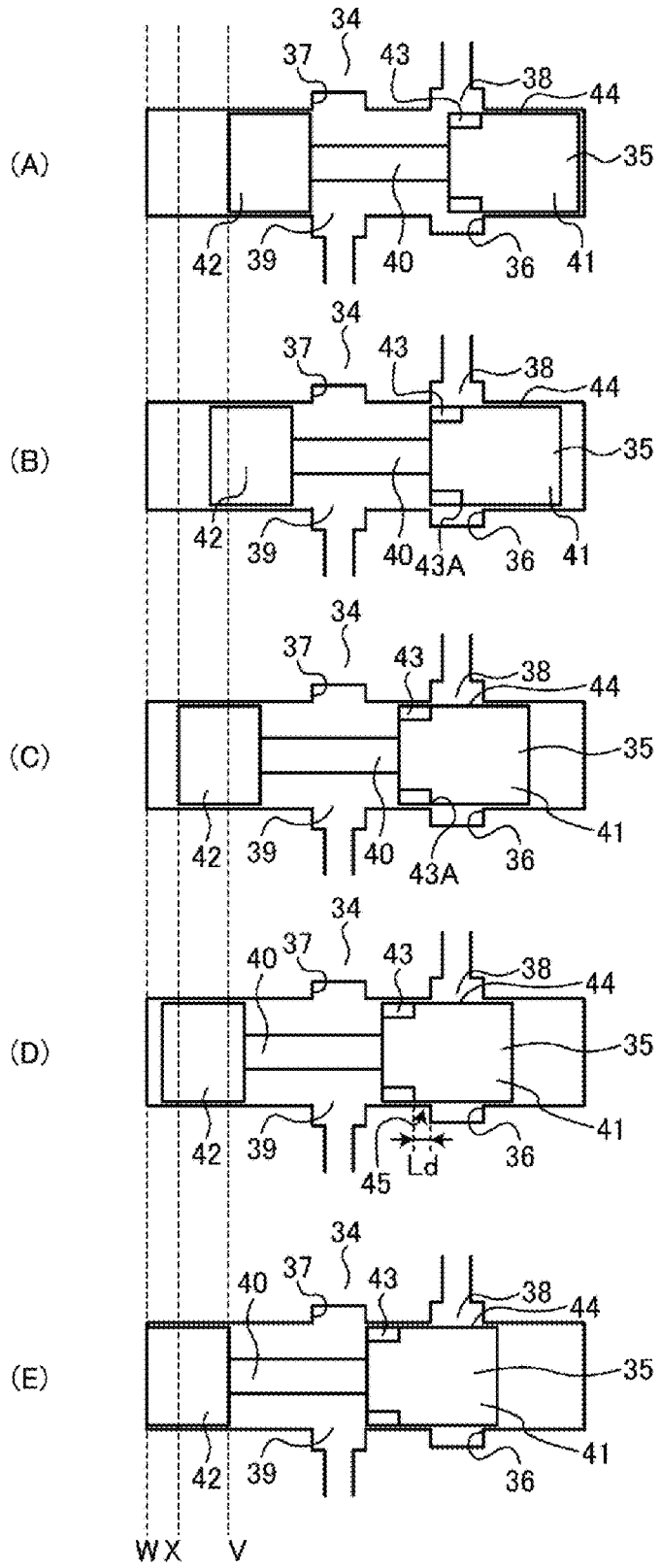
FIG. 10 is a diagram schematically illustrating an operation of the travel communication valve according to the first embodiment.

FIG. 10 is a diagram schematically illustrating an operation of the travel communication valve 26 according to the embodiment. FIG. 10(A) illustrates a state in which the spool 35 is disposed at the open position V. When the spool 35 is disposed at the open position V, the right end portion of the small-diameter rod portion 40 and the left end portion of the large-diameter rod portion 41 face the inflow port 38. The hydraulic oil from the inflow port 38 flows around an outer peripheral surface of the small-diameter rod portion 40 and the outer peripheral surface of the large-diameter rod portion 41 including the cutout portion 43. In the state illustrated in FIG. 10(A), the opening of the travel communication valve 26 through which the hydraulic oil flows is formed around the outer peripheral surface of the small-diameter rod portion 40 and around the cutout portion 43 of the large-diameter rod portion 41. Note that when a length of the small-diameter rod portion 40 facing the annular recess 36 is maximized, the opening area of the travel communication valve 26 is maximized.

FIG. 10(B) illustrates a state in which the spool 35 has moved leftward relative to the position illustrated in FIG. 10(A). The spool 35 moves leftward, and thus the cutout portion 43 and the land surface 44 of the large-diameter rod portion 41 face the inflow port 38. In the state illustrated in FIG. 10(B), the opening of the travel communication valve 26 through which the hydraulic oil flows is formed around the cutout portion 43 of the large-diameter rod portion 41. The opening area of the travel communication valve 26 in the state illustrated in FIG. 10(B) is smaller than the opening area of the travel communication valve 26 in the state illustrated in FIG. 10(A).

FIG. 10(C) illustrates a state in which the spool 35 has moved leftward relative to the position illustrated in FIG. 10(B). The spool 35 moves leftward, and thus a position of the right end portion 43A of the cutout portion 43 coincides with a position of a left end portion of the inflow port 38. The small-diameter rod portion 40 and the cutout portion 43 do not face the inflow port 38, and the land surface 44 of the large-diameter rod portion 41 faces the entire inflow port 38. In the state illustrated in FIG. 10(C), the opening of the travel communication valve 26 through which the hydraulic oil flows is formed around the land surface 44 of the large-diameter rod portion 41. In the state illustrated in FIG. 10(C), the hydraulic oil supplied from the inflow port 38 to the land surface 44 leaks from a gap between the large-diameter rod portion 41 and the valve body 34, and then flows to the outflow port 39. In the following description, a position of the spool 35 at which a position of the right end portion 43A of the cutout portion 43 of the large-diameter rod portion 41 and a position of the left end portion of the annular recess 36 coincide with each other is appropriately referred to as a cutout opening closed position X. The flow rate of the hydraulic oil passing through the travel communication valve 26 in the state illustrated in FIG. 10(C) is smaller than the flow rate of the hydraulic oil passing through the travel communication valve 26 in the state illustrated in FIG. 10(B).

FIG. 10(D) illustrates a state in which the spool 35 has moved leftward relative to the position illustrated in FIG. 10(C). The spool 35 moves leftward, and thus a gap opening 45 is formed between the land surface 44 of the large-diameter rod portion 41 and an inner peripheral surface of the valve body 34. The hydraulic oil from the inflow port 38 flows into the gap opening 45 formed around the land surface 44 of the large-diameter rod portion 41. The opening of the travel communication valve 26 through which the hydraulic oil flows includes the gap opening 45. The flow rate of the hydraulic oil leaking from the gap opening 45 decreases as a length Ld of the gap opening 45 increases. The length Ld of the gap opening 45 in the state illustrated in FIG. 10(D) is longer than the length Ld of the gap opening 45 in the state illustrated in FIG. 10(C). The flow rate of the hydraulic oil passing through the travel communication valve 26 in the state illustrated in FIG. 10(D) is smaller than the flow rate of the hydraulic oil passing through the travel communication valve 26 in the state illustrated in FIG. 10(C).

FIG. 10(E) illustrates a state in which the spool 35 has moved to the closed position W to the left of the position illustrated in FIG. 10(D). The closed position W is a position where the spool 35 has reached a stroke end in a state in which the land surface 44 of the large-diameter rod portion 41 faces the entire annular recess 36. The length Ld of the gap opening 45 when the spool 35 is disposed at the closed position W is longer than the length Ld of the gap opening 45 in the state illustrated in FIG. 10(D). The flow rate of the hydraulic oil leaking from the gap opening 45 in the state illustrated in FIG. 10(E) is smaller than the flow rate of the hydraulic oil leaking from the gap opening 45 in the state illustrated in FIG. 10(D). In the present embodiment, when the spool 35 is disposed at the closed position W, the flow rate of the hydraulic oil passing through the travel communication valve 26 is minimized.

In this way, the opening of the travel communication valve 26 through which the hydraulic oil flows includes a cutout opening formed around the small-diameter rod portion 40 and around the cutout portion 43 provided at the large-diameter rod portion 41, and a gap opening formed between the large-diameter rod portion 41 and the valve body 34. When the spool 35 moves in a first movement range between the open position V and the cutout opening closed position X, the hydraulic oil from the inflow port 38 flows into the cutout opening formed around the small-diameter rod portion 40 and around the cutout portion 43 provided at the large-diameter rod portion 41, and flows out from the outflow port 39. The opening area decreases as a leftward stroke amount of the spool 35 increases. When the spool 35 moves in a second movement range between the cutout opening closed position X and the closed position W, the hydraulic oil from the inflow port 38 flows into the gap opening 45 formed between the land surface 44 of the large-diameter rod portion 41 and the inner peripheral surface of the valve body 34, leaks from the gap opening 45, and then flows out from the outflow port 39. The flow rate of the hydraulic oil leaking from the gap opening 45 decreases as the leftward stroke amount of the spool 35 increases. In the present embodiment, adjusting the stroke of the travel communication valve 26 includes changing a position of the spool 35 in the first movement range between the open position V and the cutout opening closed position X, and changing the position of the spool 35 in the second movement range between the cutout opening closed position X and the closed position W.

Figure 11:
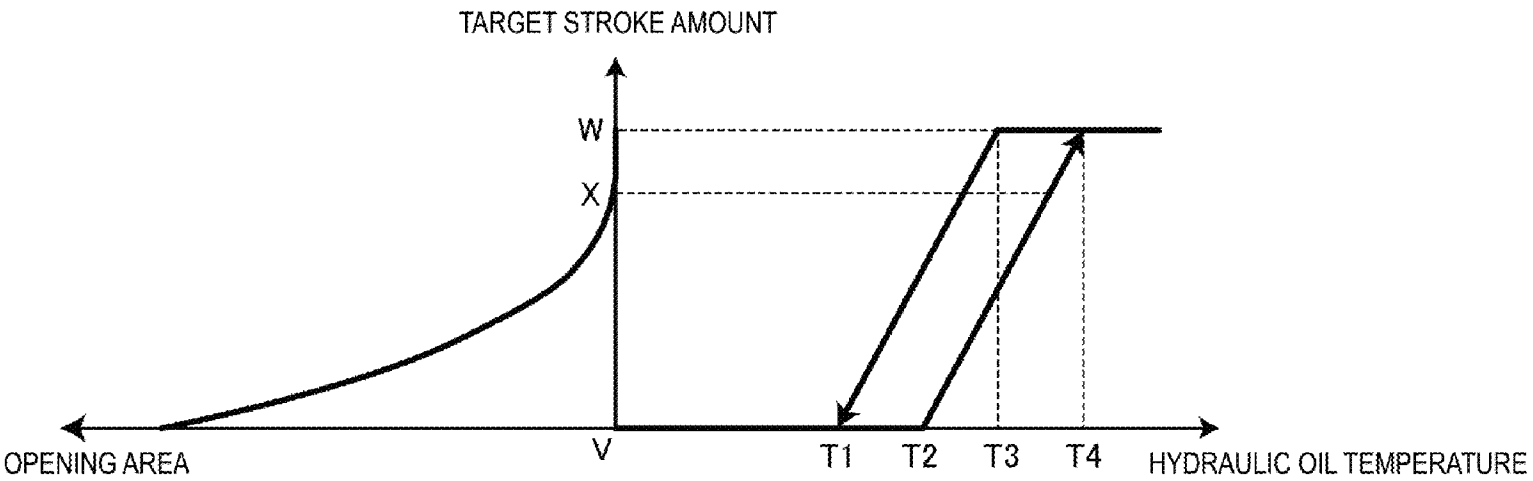
FIG. 11 is a diagram showing table data indicating a relationship between a hydraulic oil temperature, a target stroke amount, and an opening area of the travel communication valve according to the first embodiment.

FIG. 11 is a diagram showing a relationship between the hydraulic oil temperature, a target stroke amount, and the opening area of the travel communication valve 26 according to the embodiment. As shown in table data on the right side of the graph in FIG. 11, a plurality of specified temperatures T1, T2, T3, and T4 are defined for the hydraulic oil temperature. In the table data shown in FIG. 11, the specified temperature T2 is higher than the specified temperature T1, the specified temperature T3 is higher than the specified temperature T1, the specified temperature T4 is higher than the specified temperature T2, and the specified temperature T4 is higher than the specified temperature T3. When the travel communication valve 26 is in the fully open state and the hydraulic oil temperature gradually increases from a low temperature and reaches the specified temperature T2, the travel communication valve 26 starts closing. The opening area of the travel communication valve 26 gradually decreases at temperatures between the specified temperature T2 and the specified temperature T4, and the travel communication valve 26 is in the fully closed state at the specified temperature T4. When the travel communication valve 26 is in the fully closed state and the hydraulic oil temperature gradually decreases from a high temperature and reaches the specified temperature T3, the travel communication valve 26 starts opening. The opening area of the travel communication valve 26 gradually increases at temperatures between the specified temperature T3 and the specified temperature T1, and the travel communication valve 26 is in the fully open state at the specified temperature T1. Based on the table data, the control device 6 fully opens the travel communication valve 26 when the hydraulic oil temperature is equal to or lower than the specified temperature T1, which is a first temperature threshold value, and fully closes the travel communication valve 26 when the hydraulic oil temperature is equal to or higher than the specified temperature T4, which is a second temperature threshold value. The fully closed state of the travel communication valve 26 refers to a state in which the spool 35 of the travel communication valve 26 has reached the stroke end. The state in which the spool 35 has reached the stroke end is a state in which the spool 35 has reached the closed position W.

As indicated by correlation data shown on the left side of the graph in FIG. 11, in the first movement range between the open position V and the cutout opening closed position X, the opening area of the travel communication valve 26 increases as the stroke amount of the spool 35 decreases. As a result, the flow rate of the hydraulic oil passing through the travel communication valve 26 increases. In the first movement range, the opening area of the travel communication valve 26 decreases as the stroke amount of the spool 35 increases. As a result, the flow rate of the hydraulic oil passing through the travel communication valve 26 decreases. In the second movement range between the cutout opening closed position X and the closed position W, the length Ld of the gap opening 45 of the travel communication valve 26 illustrated in FIG. 10(D) decreases as the stroke amount of the spool 35 decreases. As a result, the flow rate of the hydraulic oil passing through the travel communication valve 26 increases. In the second movement range, the length Ld of the gap opening 45 of the travel communication valve 26 illustrated in FIG. 10(D) increases as the stroke amount of the spool 35 increases. As a result, the flow rate of the hydraulic oil passing through the travel communication valve 26 decreases. In each of the first movement range and the second movement range, the control device 6 can adjust the flow rate of the hydraulic oil passing through the travel communication valve 26 by controlling the stroke amount of the spool 35.

Note that the specified temperature T1 and the specified temperature T2 may be equal to each other. The specified temperature T1 and the specified temperature T3 may be equal to each other. The specified temperature T2 and the specified temperature T4 may be equal to each other. The specified temperature T3 and the specified temperature T4 may be equal to each other.

Control Method

Figure 12:
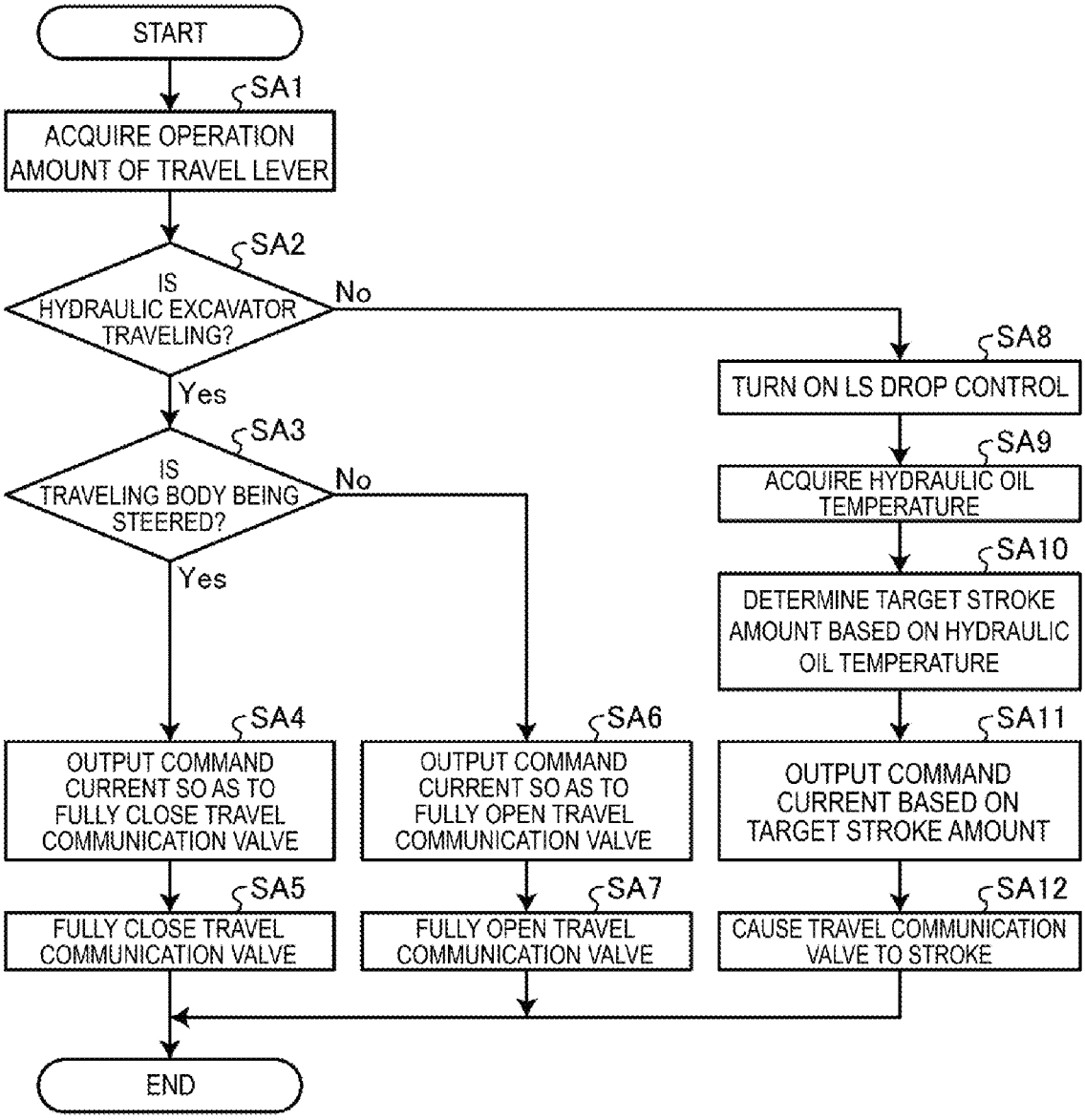
FIG. 12 is a flowchart illustrating a control method of the hydraulic system according to the first embodiment.

FIG. 12 is a flowchart illustrating a control method of the hydraulic system 10 according to the present embodiment. The control device 6 acquires the operation amount of the travel lever 31 (step SA1). The control device 6 determines whether the hydraulic excavator 1 is traveling, based on the operation amount of the travel lever 31 (step SA2). In step SA2, when it is determined that the hydraulic excavator 1 is traveling (Yes in step SA2), the control device 6 determines whether the traveling body 2 is being steered, based on the operation amount of the travel lever 31 (step SA3).

In step SA3, when it is determined that the traveling body 2 is being steered (Yes in step SA3), the control device 6 outputs a command current to the electromagnetic valve 33 so as to fully close the travel communication valve 26 (step SA4). As a result of the command current being output to the electromagnetic valve 33, the spool 35 of the travel communication valve 26 is disposed at the closed position W, and the travel communication valve 26 is fully closed (step SA5). The travel communication valve 26 is fully closed, and thus the traveling body 2 can be steered in a stable manner.

In step SA3, when it is determined that the traveling body 2 is not being steered (No in step SA3), the control device 6 outputs a command current to the electromagnetic valve 33 so as to fully open the travel communication valve 26 (step SA6). As a result of the command current being output to the electromagnetic valve 33, the spool 35 of the travel communication valve 26 is disposed at the open position V, and the travel communication valve 26 is fully opened (step SA7). As a result of the travel communication valve 26 being fully opened, as described above, the difference between the load pressure of the travel motor 7 and the load pressure of the travel motor 8 becomes small, so that the traveling body 2 can travel straight in a stable manner.

In step SA2, when it is determined that the hydraulic excavator 1 is not traveling (No in step SA2), LS drop control is started (step SA8). The control device 6 acquires the hydraulic oil temperature. That is, the control device 6 acquires the detection data from the temperature sensor 27 (step SA9).

The control device 6 determines the target stroke amount of the spool 35 of the travel communication valve 26 based on the hydraulic oil temperature (step SA10). In the present embodiment, the control device 6 determines the target stroke amount of the spool of the travel communication valve 26 based on the table data indicating the relationship between the hydraulic oil temperature and the target stroke amount described with reference to FIG. 11. The table data is predetermined. The stroke amount of the spool of the travel communication valve 26 and the opening area of the travel communication valve 26 have a negative correlation. The opening area decreases as the stroke amount increases, and the opening area increases as the stroke amount decreases.

The control device 6 determines the target stroke amount based on the detection data from the temperature sensor 27 and the table data, and then outputs a command current to the electromagnetic valve 33 based on the target stroke amount (step SA11). As a result of the command current being output to the electromagnetic valve 33, the travel communication valve 26 strokes, and the opening area of the travel communication valve 26 is adjusted (step SA12). By adjusting the opening area of the travel communication valve 26, a fluctuation in the LS drop amount $[P_L-P_{LS}]$ is suppressed.

Effects

As described above, in the present embodiment, the stroke of the travel communication valve 26 is adjusted based on the hydraulic oil temperature. Therefore, even when the hydraulic oil temperature changes, a great fluctuation in the LS drop amount $[P_L-P_{LS}]$ is suppressed. Since a fluctuation in the LS drop amount $[P_L-P_{LS}]$ is suppressed, the appropriate LS pressure $P_{LS}$ is obtained. This suppresses deterioration in the operability of the work equipment 4.

Second Embodiment

A second embodiment will be described. In the following description, components that are the same as or equivalent to those of the above-described embodiment are denoted by the same reference numerals, and description thereof is simplified or omitted.

Figure 13:
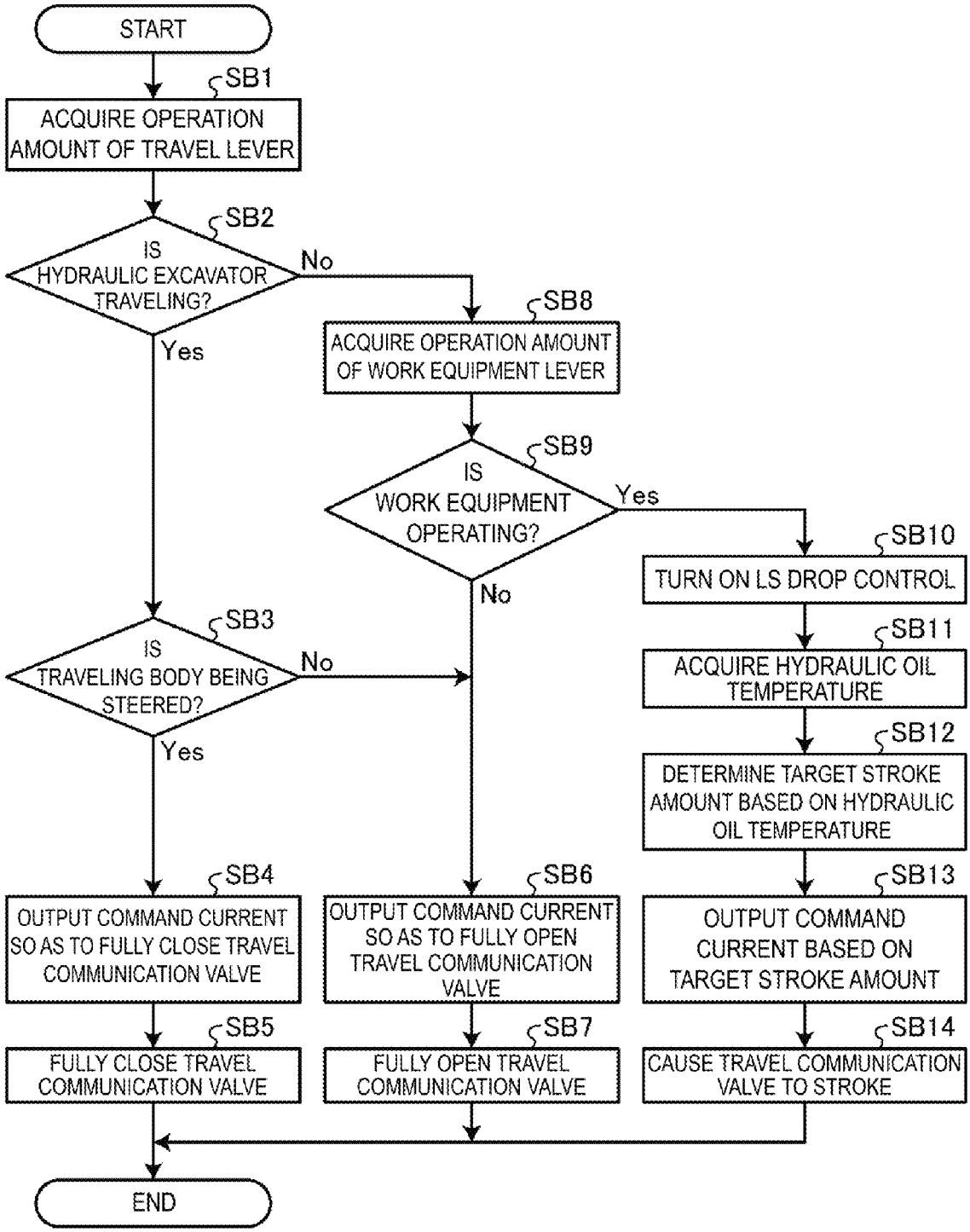
FIG. 13 is a flowchart illustrating a control method of the hydraulic system according to a second embodiment.

FIG. 13 is a flowchart illustrating a control method of the hydraulic system 10 according to the present embodiment. Since step SB1 to step SB7 are the same as step SA1 to step SA7 described with reference to FIG. 12, description thereof is omitted.

In step SB8, the control device 6 acquires the operation amount of the work lever 32 (step SB8). The control device 6 determines whether the work equipment 4 is operating, based on the operation amount of the work lever 32 (step SB9). In step SB9, when it is determined that the work equipment 4 is not operating (No in step SB9), the control device 6 performs the processing of step SB6 and the processing of step SB7. When each of the travel motor 7, the travel motor 8, and the work equipment cylinder 5 is not operating, the travel communication valve 26 is fully opened. In a case where a pilot pressure is input to a pilot port of the travel communication valve 26 when a command current is input to the electromagnetic valve 33 and the travel communication valve 26 is fully closed, and the travel communication valve 26 is fully opened by a spring force when the command current is not input to the electromagnetic valve 33, the pilot pressure is prevented from being input to the travel communication valve 26 when each of the travel motor 7, the travel motor 8, and the work equipment cylinder 5 is not operating, thereby suppressing leakage of pilot oil in a pilot circuit. This suppresses deterioration in fuel consumption of the hydraulic excavator 1.

In step SB9, when it is determined that the work equipment 4 is operating (Yes in step SB9), LS drop control is started (step SB10). The control device 6 acquires the hydraulic oil temperature (step SB11). The control device 6 determines the target stroke amount of the travel communication valve 26 based on the detection data from the temperature sensor 27 and the table data described with reference to FIG. 10 (step SB12). After determining the target stroke amount, the control device 6 outputs a command current to the electromagnetic valve 33 based on the target stroke amount (step SB13). As a result of the command current being output to the electromagnetic valve 33, the spool 35 of the travel communication valve 26 strokes, and the opening area of the travel communication valve 26 is adjusted (step SB14). By adjusting the opening area of the travel communication valve 26, a fluctuation in the LS drop amount $[P_L-P_{LS}]$ is suppressed.

Third Embodiment

A third embodiment will be described. In the following description, components that are the same as or equivalent to those of the above-described embodiment are denoted by the same reference numerals, and description thereof is simplified or omitted.

Figure 14:
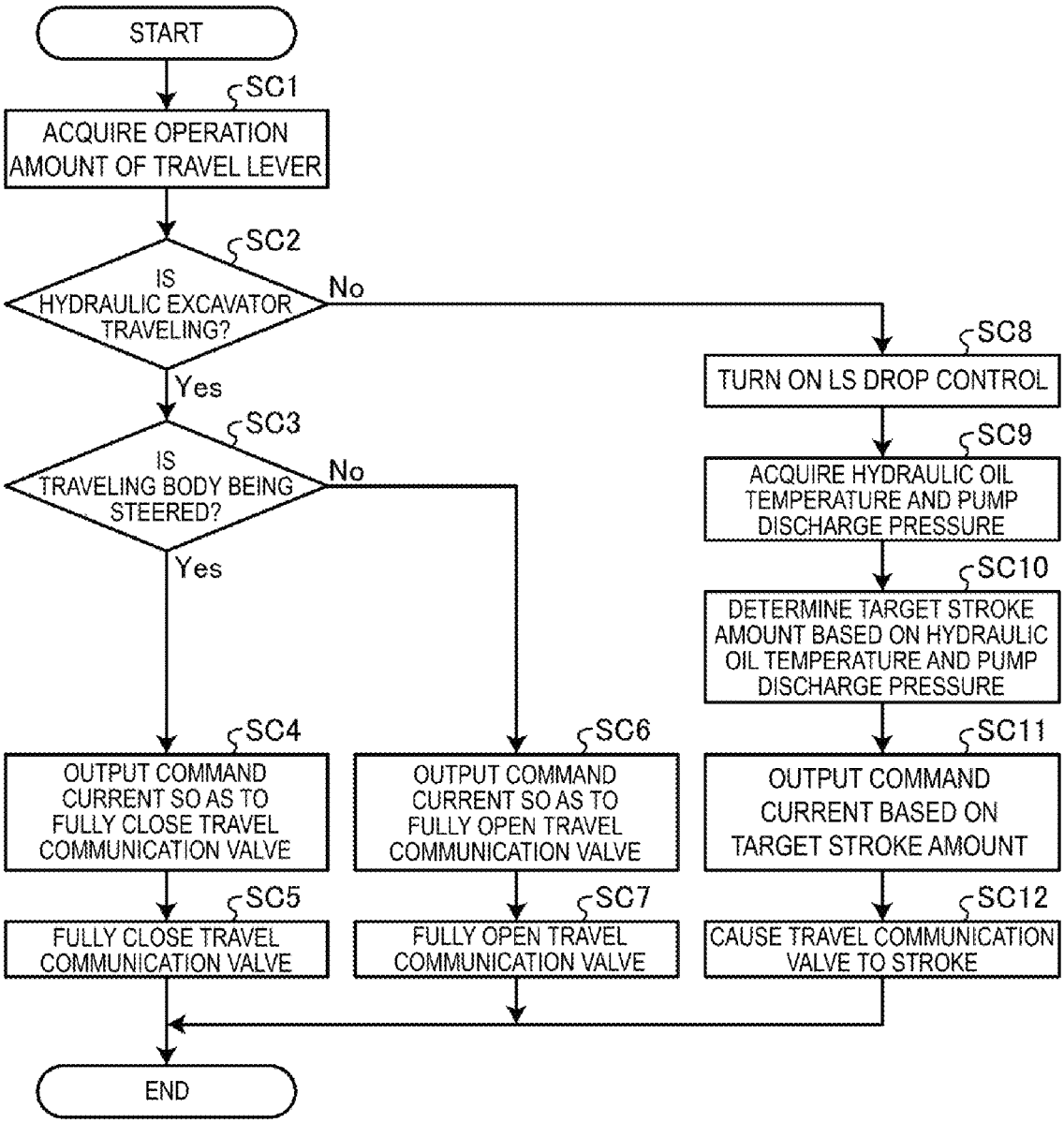
FIG. 14 is a flowchart illustrating a control method of the hydraulic system according to a third embodiment.

FIG. 14 is a flowchart illustrating a control method of the hydraulic system 10 according to the present embodiment. Since step SC1 to step SC7 are the same as step SA1 to step SA7 described with reference to FIG. 12, description thereof is omitted.

In step SC2, when it is determined that the hydraulic excavator 1 is not traveling (No in step SC2), LS drop control is started (step SC8).

The control device 6 acquires the hydraulic oil temperature and the pump discharge pressure $P_P$. That is, the control device 6 acquires the detection data from the temperature sensor 27 and detection data from the pressure sensor 28 (step SC9). In the present embodiment, the control device 6 adjusts the stroke of the travel communication valve 26 based on the detection data from the temperature sensor 27 and the detection data from the pressure sensor 28. That is, the control device 6 determines the target stroke amount of the travel communication valve 26, based on the hydraulic oil temperature and the pump discharge pressure $P_P$ (step SC10).

The control device 6 determines a first candidate value of the target stroke amount of the travel communication valve 26, based on the detection data from the temperature sensor 27 and the table data described with reference to FIG. 11. Further, the control device 6 determines a second candidate value of the target stroke amount of the travel communication valve 26, based on table data indicating a predetermined relationship between the pump discharge pressure $P_P$ and the target stroke amount.

Figure 15:
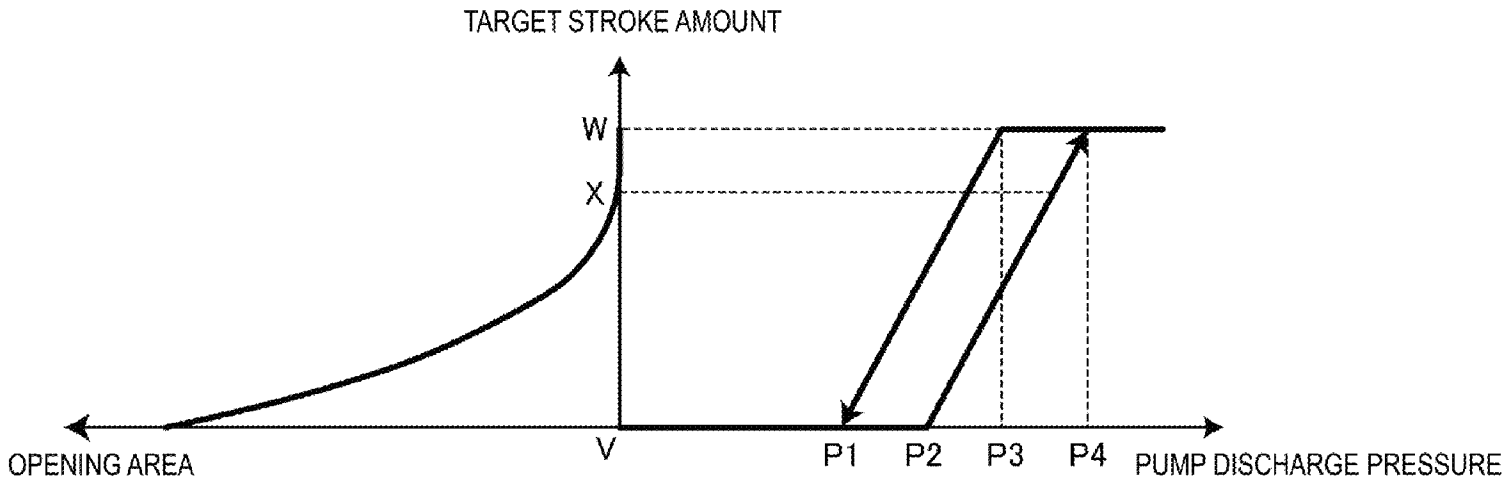
FIG. 15 is a diagram showing table data indicating a relationship between a pump discharge pressure, a target stroke amount, and an opening area of a travel communication valve according to the third embodiment.

FIG. 15 is a diagram showing a relationship between the pump discharge pressure $P_P$, the target stroke amount, and the opening area of the travel communication valve 26 according to the present embodiment. As indicated by table data shown on the right side of the graph in FIG. 15, a plurality of specified pressures P1, P2, P3, and P4 are defined for the pump discharge pressure $P_P$. In the table data shown in FIG. 15, the specified pressure P2 is higher than the specified pressure P1, the specified pressure P3 is higher than the specified pressure P1, the specified pressure P4 is higher than the specified pressure P2, and the specified pressure P4 is higher than the specified pressure P3. When the travel communication valve 26 is in the fully open state and the pump discharge pressure $P_P$ gradually increases from a low pressure and reaches the specified pressure P2, the travel communication valve 26 starts closing. The opening area of the travel communication valve 26 gradually decreases at pressures between the specified pressure P2 and the specified pressure P4, and the travel communication valve 26 is in the fully closed state at the specified pressure P4. When the travel communication valve 26 is in the fully closed state and the pump discharge pressure $P_P$ gradually decreases from a high pressure and reaches the specified pressure P3, the travel communication valve 26 starts opening. The opening area of the travel communication valve 26 gradually increases at pressures between the specified pressure P3 and the specified pressure P1, and the travel communication valve 26 is in the fully open state at the specified pressure P1. Based on the table data, the control device 6 fully opens the travel communication valve 26 when the pump discharge pressure $P_P$ is equal to or lower than the specified pressure P1, which is a first pressure threshold value, and fully closes the travel communication valve 26 when the pump discharge pressure $P_P$ is equal to or higher than the specified pressure P4, which is a second pressure threshold value. The fully closed state of the travel communication valve 26 refers to a state in which the spool of the travel communication valve 26 has reached the stroke end. The state in which the spool 35 has reached the stroke end is a state in which the spool 35 has reached the closed position W.

As indicated by correlation data shown on the left side of the graph in FIG. 15, in the first movement range between the open position V and the cutout opening closed position X, the opening area of the travel communication valve 26 increases as the stroke amount of the spool 35 decreases. As a result, the flow rate of the hydraulic oil passing through the travel communication valve 26 increases. In the first movement range, the opening area of the travel communication valve 26 decreases as the stroke amount of the spool 35 increases. As a result, the flow rate of the hydraulic oil passing through the travel communication valve 26 decreases. In the second movement range between the cutout opening closed position X and the closed position W, the length Ld of the gap opening 45 of the travel communication valve 26 illustrated in FIG. 10(D) decreases as the stroke amount of the spool 35 decreases. As a result, the flow rate of the hydraulic oil passing through the travel communication valve 26 increases. In the second movement range, the length Ld of the gap opening 45 of the travel communication valve 26 illustrated in FIG. 10(D) increases as the stroke amount of the spool 35 increases. As a result, the flow rate of the hydraulic oil passing through the travel communication valve 26 decreases. In each of the first movement range and the second movement range, the control device 6 can adjust the flow rate of the hydraulic oil passing through the travel communication valve 26 by controlling the stroke amount of the spool 35.

Note that the specified pressure P1 and the specified pressure P2 may be equal to each other. The specified pressure P1 and the specified pressure P3 may be equal to each other. The specified pressure P2 and the specified pressure P4 may be equal to each other. The specified pressure P3 and the specified pressure P4 may be equal to each other.

The control device 6 determines the second candidate value of the target stroke amount based on the detection data from the pressure sensor 28 and the table data described with reference to FIG. 15. In FIG. 14, the control device 6 sets a smaller one of the first candidate value determined based on the hydraulic oil temperature and the second candidate value determined based on the pump discharge pressure $P_P$ as the target stroke amount. After determining the target stroke amount, the control device 6 outputs a command current to the electromagnetic valve 33 based on the target stroke amount (step SC11). As a result of the command current being output to the electromagnetic valve 33, the travel communication valve 26 strokes, and the opening area of the travel communication valve 26 is adjusted (step SC12). By adjusting the opening area of the travel communication valve 26, a fluctuation in the LS drop amount $[P_L-P_{LS}]$ is suppressed.

In a case where a pilot pressure is input to the pilot port of the travel communication valve 26 when the command current is input to the electromagnetic valve 33 and the travel communication valve 26 is fully closed, and the travel communication valve 26 is fully opened by a spring force when the command current is not input to the electromagnetic valve 33, the pilot pressure is prevented from being input to the travel communication valve 26 when the pump discharge pressure $P_P$ is low and influence of a fluctuation in the LS drop amount $[P_L-P_{LS}]$ is small, thereby suppressing leakage of pilot oil in the pilot circuit. This suppresses deterioration in operability of the hydraulic excavator 1 and deterioration in fuel consumption.

REFERENCE SIGNS LIST

1 Hydraulic excavator, 2 Traveling body, 2A Crawler belt, 3 Rotating body, 4 Work equipment, 4A Boom, 4B Arm, 4C Bucket, 5 Work equipment cylinder, 5A Boom cylinder, 5B Arm cylinder, 5C Bucket cylinder, 6 Control device, 7 Travel motor (first travel motor), 7A Port, 7B Port, 8 Travel motor (second travel motor), 8A Port, 8B Port, 10 Hydraulic system, 11 Hydraulic pump, 12 Hydraulic oil tank, 13 Travel operation valve (first travel operation valve), 13A First port, 13B Second port, 13C Third port, 13D Fourth port, 13E Fifth port, 13F Sixth port, 13G Seventh port, 13M Meter-in throttle, 13N Meter-in throttle, 14 Travel operation valve (second travel operation valve), 14A First port, 14B Second port, 14C Third port, 14D Fourth port, 14E Fifth port, 14F Sixth port, 14G Seventh port, 14M Meter-in throttle, 14N Meter-in throttle, 15 Work equipment operation valve, 15A First port, 15B Second port, 15C Third port, 15D Fourth port, 15E Fifth port, 15F Sixth port, 15G Seventh port, 15M Meter-in throttle, 15N Meter-in throttle, 16 Pressure compensation unit, 16A Input port, 16B Output port, 16C Inlet flow path, 16D Check valve, 16E Load sensing inlet throttle (LS inlet throttle), 16S Pressure compensation valve (first pressure compensation valve), 17 Pressure compensation unit, 17A Input port, 17B Output port, 17C Inlet flow path, 17D Check valve, 17E Load sensing inlet throttle (LS inlet throttle), 17F Bypass flow path, 17G Bypass throttle, 17S Pressure compensation valve (second pressure compensation valve), 18 Pressure compensation unit, 18A Input port, 18B Output port, 18C Inlet flow path, 18D Check valve, 18E Load sensing inlet throttle (LS inlet throttle), 18S Pressure compensation valve, 19 Pump flow path, 20 Coupling flow path, 21 Tank flow path, 22 Signal flow path, 23 Throttle, 24 Load sensing valve (LS valve), 25 Servo piston, 26 Travel communication valve, 27 Temperature sensor, 28 Pressure sensor, 31 Travel lever, 32 Work lever, 33 Electromagnetic valve, 34 Valve body, 35 Spool, 36 Annular recess, 37 Annular recess, 38 Inflow port, 39 Outflow port, 40 Small-diameter rod portion, 41 Large-diameter rod portion, 42 Large-diameter rod portion, 43 Cutout portion, 43A Right end portion, 44 Land surface, 45 Gap opening, 50A Port, 50B Port, A Fully open position, B Fully closed position, D Retraction position, F Forward position, H High differential pressure position, L Low differential pressure position, La Line, Lb Line, Lc Line, Ld Length, N Neutral position, $P_L$ Load pressure, $P_{LS}$ LS pressure, $P_P$ Pump discharge pressure, R Reverse position, U Extension position, Ya Increase direction, Yb Decrease direction, V Open position, W Closed position, X Cutout opening closed position

The invention claimed is:

1. A work machine comprising:

a hydraulic pump configured to change a discharge amount of hydraulic oil based on a differential pressure between a pump discharge pressure and a load sensing pressure corresponding to a load pressure input via a signal flow path;

a first travel motor configured to be driven by the hydraulic oil supplied from the hydraulic pump;

a second travel motor configured to be driven by the hydraulic oil supplied from the hydraulic pump;

a work equipment cylinder configured to be driven by the hydraulic oil supplied from the hydraulic pump;

a first travel operation valve configured to control a flow rate and a direction of the hydraulic oil supplied from the hydraulic pump to the first travel motor;

a second travel operation valve configured to control a flow rate and a direction of the hydraulic oil supplied from the hydraulic pump to the second travel motor;

a work equipment operation valve configured to control a flow rate and a direction of the hydraulic oil supplied from the hydraulic pump to the work equipment cylinder;

a first pressure compensation valve connected to the signal flow path via a first inlet flow path, the first pressure compensation valve being configured to compensate for a differential pressure across the first travel operation valve based on the load sensing pressure;

a second pressure compensation valve connected to the signal flow path via a second inlet flow path, the second pressure compensation valve being configured to compensate for a differential pressure across the second travel operation valve based on the load sensing pressure;

a bypass flow path configured to bypass at least part of the second inlet flow path;

a travel communication valve disposed at a coupling flow path coupling the first travel operation valve and the second travel operation valve;

a temperature sensor configured to detect a hydraulic oil temperature indicating a temperature of the hydraulic oil; and a control device configured to adjust a stroke of the travel communication valve based on detection data from the temperature sensor in a state in which each of the first travel operation valve and the second travel operation valve is disposed at a neutral position.

2. The work machine according to claim 1, wherein an opening area of the travel communication valve is adjusted by adjusting the stroke of the travel communication valve, and the control device increases the opening area as the hydraulic oil temperature decreases, and decreases the opening area as the hydraulic oil temperature increases.

3. The work machine according to claim 1, wherein the control device fully opens the travel communication valve when the hydraulic oil temperature is equal to or lower than a first temperature threshold value, and fully closes the travel communication valve when the hydraulic oil temperature is equal to or higher than a second temperature threshold value.

4. The work machine according to claim 1, comprising:

a pressure sensor configured to detect the pump discharge pressure, wherein the control device adjusts the stroke of the travel communication valve based on the detection data from the temperature sensor and detection data from the pressure sensor.

5. The work machine according to claim 4, wherein the control device fully opens the travel communication valve when the pump discharge pressure is equal to or lower than a first pressure threshold value, and fully closes the travel communication valve when the pump discharge pressure is equal to or higher than a second pressure threshold value.

6. The work machine according to claim 1, wherein the control device adjusts the stroke of the travel communication valve when activating the work equipment operation valve.

7. The work machine according to claim 1, wherein the travel communication valve includes a valve body and a spool movable inside the valve body, the spool includes a small-diameter rod portion and a large-diameter rod portion connected to the small-diameter rod portion, an opening of the travel communication valve through which the hydraulic oil flows includes a cutout opening formed around the small-diameter rod portion and around a cutout portion provided at the large-diameter rod portion, and a gap opening formed between the large-diameter rod portion and the valve body, the spool moves in a first movement range in which the hydraulic oil from an inflow port of the valve body flows into the cutout opening and in a second movement range in which the hydraulic oil from the inflow port flows into the gap opening, and adjusting the stroke of the travel communication valve includes changing a position of the spool in the first movement range and changing the position of the spool in the second movement range.

* * * * *